United States Patent [19]

Minkoff et al.

[11] 4,372,556

[45] Feb. 8, 1983

[54] ELECTRONIC SOCCER GAME

[75] Inventors: Michael D. Minkoff, Torrance; Richard S. Chang, Rolling Hills Estate, both of Calif.

[73] Assignee: Mattel, Inc., Hawthorne, Calif.

[21] Appl. No.: 176,307

[22] Filed: Aug. 8, 1980

[51] Int. Cl.[3] ..... A63F 9/00

[52] U.S. Cl. ..... 273/85 G; 273/313

[58] Field of Search ..... 273/85 G, 94, 88, DIG. 28, 273/1 E, 1 GC, 313; 364/410

[56] References Cited

U.S. PATENT DOCUMENTS

| | | | |
|---|---|---|---|
| 3,874,669 | 4/1975 | Ariano et al. | 273/85 G |
| 4,026,555 | 5/1977 | Kirschner et al. | 273/85 G |
| 4,093,221 | 6/1978 | Dash | 273/85 G |
| 4,162,792 | 7/1979 | Chang et al. | 273/94 R |
| 4,249,734 | 2/1981 | Bromley | 273/94 |
| 4,249,744 | 2/1981 | Bromley | 273/313 |

*Primary Examiner*—Vance Y. Hum

*Attorney, Agent, or Firm*—Reagin & King

[57] ABSTRACT

A portable electronic game for simulating the play of the game of soccer including a housing mounting a display and containing circuitry for controlling the play of the game in accordance with the rules of the game of soccer. The housing also mounts a number of input keys for providing input signals for controlling the movement of the ball and one of more offensive players shown on the display. In the preferred embodiment, a goalkeeper and five defenders are operated by the control circuitry and formations are provided for kickoffs, throw-ins, corner kicks, and goal kicks.

13 Claims, 27 Drawing Figures

VDD
VSS
70
CLOCK CONTROL CIRCUIT 66
TO SLAVE CK1 ON SLAVE CONT. 56
G1
CK1
MASTER CONTR. 58
420L
RESET
SO
S1
L0
L1
L2
L4
L5
L6
L7
LED MATRIX DISPLAY 18
30
RIGHT DIGIT
LEFT DIGIT
36
34
32
10
D3
D2
D1
D0
G3
G2
G1
G0
IN0 19
IN1 9
IN2 10
IN3 20
P1:1
P2:0
SLAVE CONTR. 56
SK
TO CLOCK CONTROL CKT.
23
24
25
22
21
H/L
SCORE
T-M
PASS
SHOOT
DN
UP
L
R
28
26
27
29
20
55
52
54
50
9V
62
64
60
1N914

330
OPERAT

BRANCH TO ROUTINES ON GENREQ VALUE
332
Φ
1
2
3
4
5
6
130
RET
334
KCKOFF
336
THROIN
338
CORKIK
GOLKIK
340
238

SECNDS
184
STEP 122
186
TIME FOR A TICK OR BUZZ ?
NO
124
RET
YES
(IN BOUNDS TURNOVER)
188
BALL HELD ?
YES
190
TICK
342
MOVE HANDLER TO BALL'S POSIT.
344
MIRROR CONFIGURATION ABOUT COLUMN "3"
192
NO
SHORT BUZZ
130
RET
124
RET
124
RET

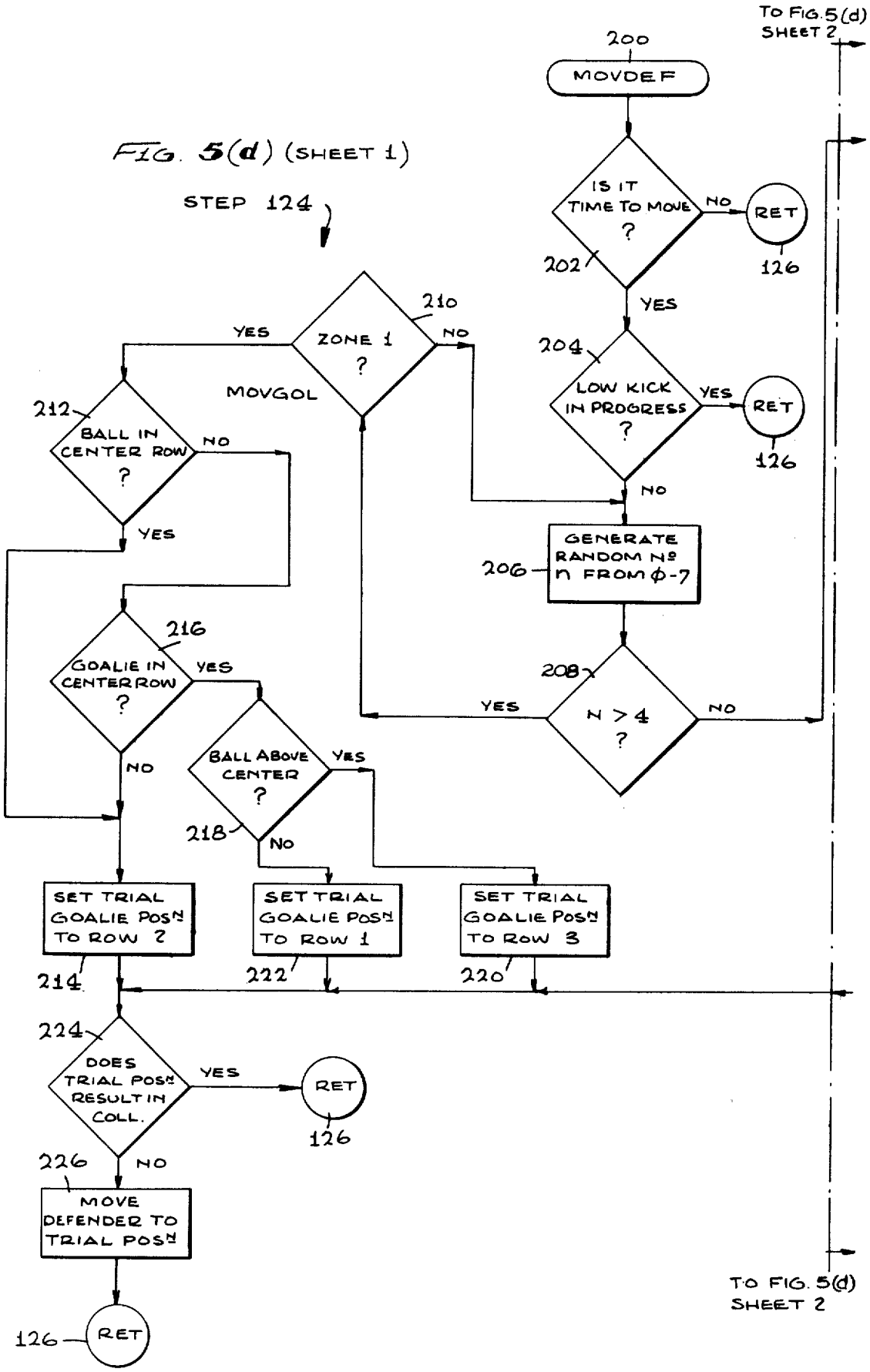
FIG. 5(d) (SHEET 1)
STEP 124
TO FIG. 5(d) SHEET 2
200
MOVDEF
IS IT TIME TO MOVE ?
NO
RET
126
202
YES
204
LOW KICK IN PROGRESS ?
YES
RET
126
NO
GENERATE RANDOM Nº n FROM Φ-7
206
208
N > 4 ?
YES
NO
210
ZONE 1 ?
YES
NO
MOVGOL
212
BALL IN CENTER ROW ?
NO
YES
216
GOALIE IN CENTER ROW ?
YES
NO
BALL ABOVE CENTER ?
YES
218
NO
SET TRIAL GOALIE POSN TO ROW 2
214
SET TRIAL GOALIE POSN TO ROW 1
222
SET TRIAL GOALIE POSN TO ROW 3
220
224
DOES TRIAL POSN RESULT IN COLL.
YES
RET
126
226
NO
MOVE DEFENDER TO TRIAL POSN
126
RET
TO FIG. 5(d) SHEET 2

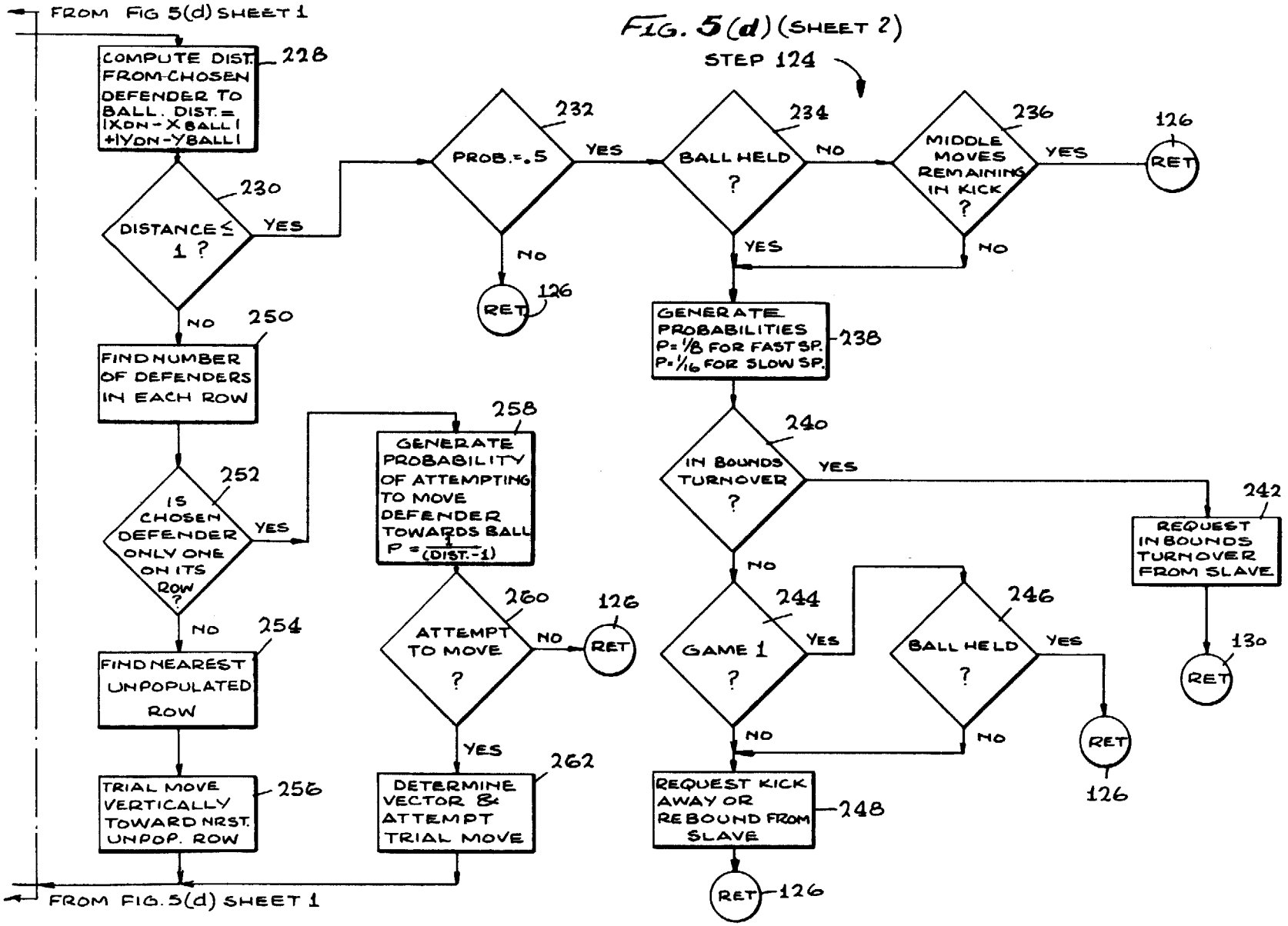
FIG. 5(d) (SHEET 2)
STEP 124
FROM FIG 5(d) SHEET 1
COMPUTE DIST. FROM CHOSEN DEFENDER TO BALL. DIST. = |XDN-XBALL| + |YDN-YBALL|
228
DISTANCE ≤ 1 ?
230
YES
NO
PROB. = .5
232
YES
NO
RET
126
BALL HELD ?
234
NO
YES
MIDDLE MOVES REMAINING IN KICK ?
236
YES
NO
RET
126
GENERATE PROBABILITIES P = 1/8 FOR FAST SP. P = 1/16 FOR SLOW SP.
238
FIND NUMBER OF DEFENDERS IN EACH ROW
250
IS CHOSEN DEFENDER ONLY ONE ON ITS ROW ?
252
YES
NO
GENERATE PROBABILITY OF ATTEMPTING TO MOVE DEFENDER TOWARDS BALL P = 1/(DIST.-1)
258
FIND NEAREST UNPOPULATED ROW
254
TRIAL MOVE VERTICALLY TOWARD NRST. UNPOP. ROW
256
FROM FIG. 5(d) SHEET 1
IN BOUNDS TURNOVER ?
240
YES
NO
REQUEST IN BOUNDS TURNOVER FROM SLAVE
242
RET
130
GAME 1 ?
244
YES
NO
BALL HELD ?
246
YES
NO
RET
126
REQUEST KICK AWAY OR REBOUND FROM SLAVE
248
RET
126
ATTEMPT TO MOVE ?
260
YES
NO
RET
126
DETERMINE VECTOR & ATTEMPT TRIAL MOVE
262

SHEET 1

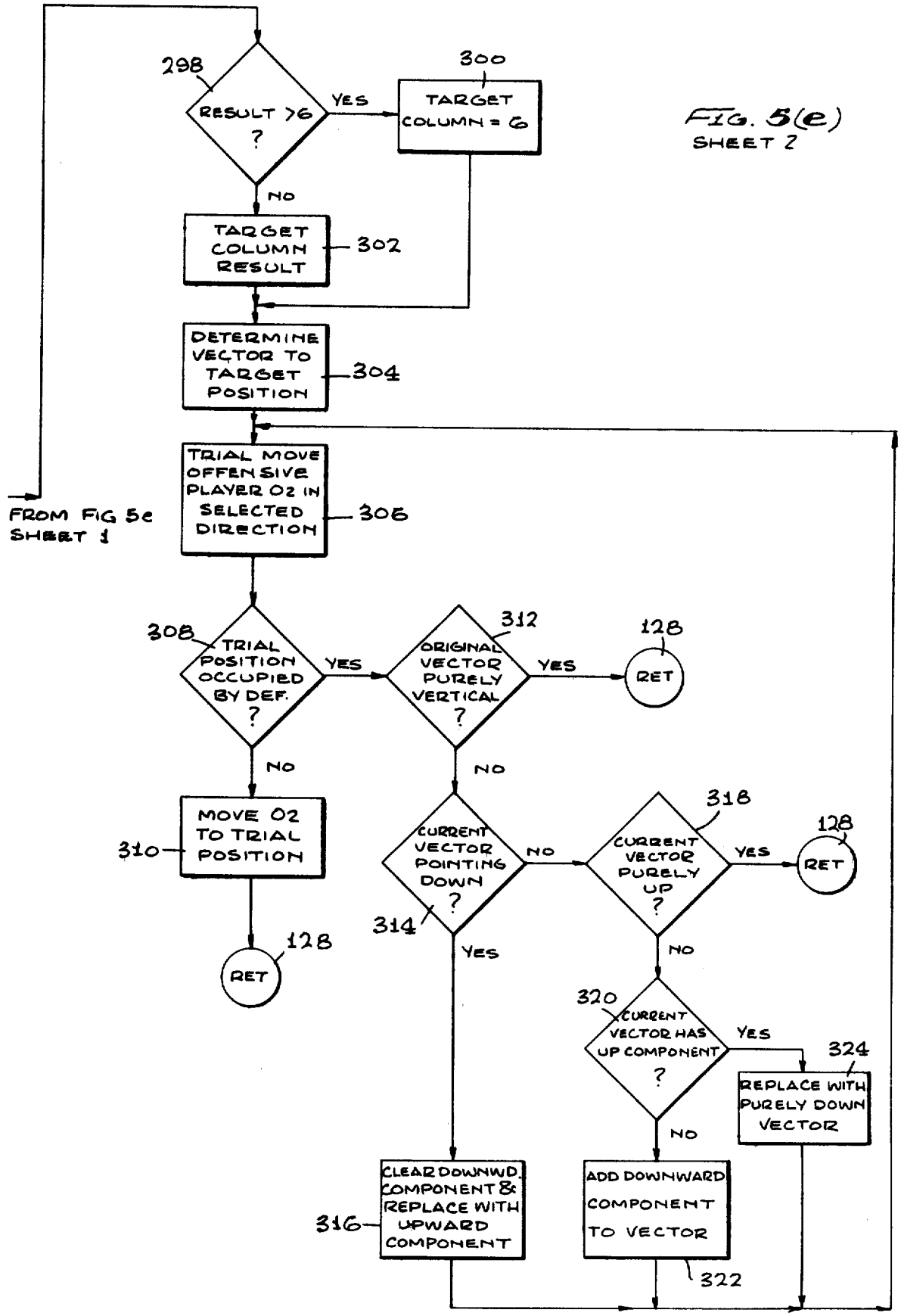
FIG. 5(e)
SHEET 2
298
RESULT >6 ?
YES
300
TARGET COLUMN = 6
NO
TARGET COLUMN RESULT
302
DETERMINE VECTOR TO TARGET POSITION
304
FROM FIG 5e SHEET 1
TRIAL MOVE OFFENSIVE PLAYER O2 IN SELECTED DIRECTION
306
308
TRIAL POSITION OCCUPIED BY DEF. ?
YES
312
ORIGINAL VECTOR PURELY VERTICAL ?
YES
128
RET
NO
NO
MOVE O2 TO TRIAL POSITION
310
CURRENT VECTOR POINTING DOWN ?
314
NO
318
CURRENT VECTOR PURELY UP ?
YES
128
RET
128
RET
YES
NO
320
CURRENT VECTOR HAS UP COMPONENT ?
YES
324
REPLACE WITH PURELY DOWN VECTOR
NO
CLEAR DOWNWD. COMPONENT & REPLACE WITH UPWARD COMPONENT
316
ADD DOWNWARD COMPONENT TO VECTOR
322

SHEET 1

SHEET 2

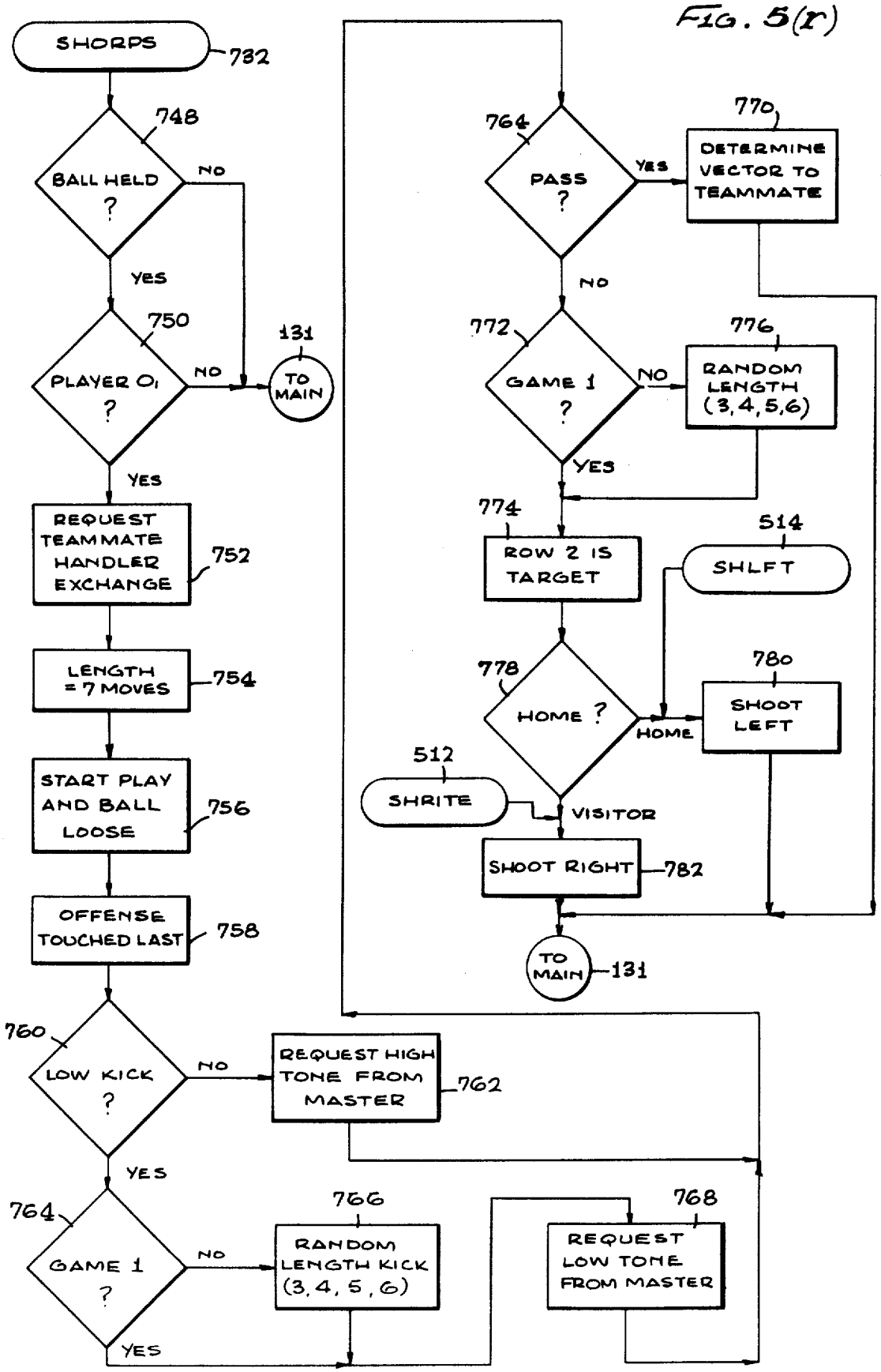
FIG. 5(r)
SHORPS
732
748
BALL HELD ?
NO
YES
750
PLAYER O1 ?
NO
131
TO MAIN
YES
REQUEST TEAMMATE HANDLER EXCHANGE
752
LENGTH = 7 MOVES
754
START PLAY AND BALL LOOSE
756
OFFENSE TOUCHED LAST
758
760
LOW KICK ?
NO
REQUEST HIGH TONE FROM MASTER
762
YES
764
GAME 1 ?
NO
YES
766
RANDOM LENGTH KICK (3, 4, 5, 6)
768
REQUEST LOW TONE FROM MASTER
764
PASS ?
YES
770
DETERMINE VECTOR TO TEAMMATE
NO
772
GAME 1 ?
NO
776
RANDOM LENGTH (3, 4, 5, 6)
YES
774
ROW 2 IS TARGET
514
SHLFT
778
HOME ?
HOME
780
SHOOT LEFT
512
SHRITE
VISITOR
SHOOT RIGHT
782
TO MAIN
131

ELECTRONIC SOCCER GAME

BACKGROUND OF THE INVENTION

This invention relates to games and, more particularly, to electronic games for simulating the play of athletic games.

People appear to have been involved in the playing of games since the beginning of recorded history. The almost universal interest in games seems to be due to the excitement engendered by competition, chance, and the increased return to a player as his skill increases. Competitive games are more exciting, other factors being equal; but, they normally require that more than one person be involved in each such game.

Recently, various improvements in electronic circuitry have allowed the reduction in size and cost of data processing circuitry and have led to electronic circuits which simulate the play of a competitor in certain well known games. In these electronic games, a person plays against an electronic competitor thereby eliminating the necessity for human opponents. Many of these electronic games are quite expensive. Often, the game must be connected to a television set to provide a display upon which the game may be presented.

Recently, a number of portable electronic games have been devised by which a person may play a particular simulated sports game such as football, basketball, or baseball. These portable games have their own built-in displays and are much less expensive, in general, than those which must be connected to a television set. Furthermore, their small size allows them to be carried about and used almost anywhere. However, these portable electronic games have relatively small displays, contain a limited amount of circuitry, and must be powered by battery. Consequently, the portable electronic games heretofore devised have been relatively unsophisticated as contrasted to those which are associated with television sets.

It is, consequently, an object of this invention to provide a new and improved portable electronic soccer game.

It is another object of this invention to provide a new and improved electronic game capable of simulating the play of a game of soccer at a sophisticated level.

It is another object of this invention to provide an electronic soccer game operable at different levels of sophistication.

SUMMARY OF THE INVENTION

The foregoing and other objects of the invention are accomplished by a portable electronic soccer game which has an exterior housing mounting a display upon which the various players, the ball, and results are presented. The housing also mounts input keys for controlling the operation of the game and contains electronic data processing circuitry organized to provide the play of soccer in response to the various input keys. Additional features may be selectively added or the speed increased so that the game becomes more complicated and exciting.

In playing the game, two offensive players, five defensive players, and a goalkeeper are utilized. One or the other of the offensive players is controlled by the operator to move in directions and to direct high or low passes to the other offensive player which is moved automatically by the data processing circuitry. The player controlled by the operator may also dribble the ball and may selectively initiate high or low shots toward the goal. The defensive players, including the goalkeeper, react automatically under control of data processing circuitry as would human defenders under like circumstances. Various formations including throw-ins, corner kicks, inbounds turnovers, and goal kicks are also provided to suit particular situations of play.

Other objects, features, and advantages of the invention will become apparent by reference to the specification taken in conjunction with the drawings in which like elements are referred to by like reference designations throughout the several views.

DESCRIPTION OF THE PREFERRED EMBODIMENT

Figure 1:
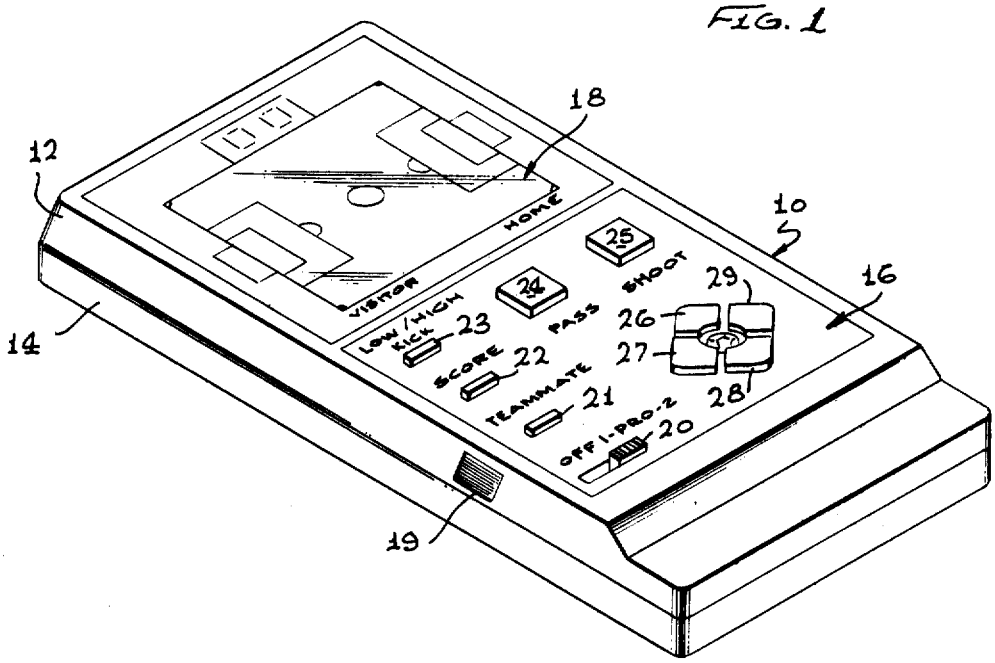
FIG. 1 is a perspective view of the exterior housing of an electronic soccer game constructed in accordance with the invention.

Referring now to the drawings and, more particularly, to FIG. 1, there is shown a perspective view of an electronic soccer game 10 constructed in accordance with this invention. The game 10 includes an upper housing 12 and a lower housing 14 each of which may be constructed of a moldable plastic material. The housings 12 and 14 may be joined together in a conventional manner to form a hollow interior for containing electronic components. The upper housing 12 mounts a control panel 16 which includes a display 18, a speaker 19, and keys 20–29. The key 20 is designated "Off 1-Pro-2;" the key 21, "Teammate;" the key 22, "Score;" the key 23, "Low/High;" the key 24, "Pass;" the key 25, "Shoot;" the key 26, "Up;" the key 27, "Left;" the key 28, "Down;" and the key 29, "Right." On the bottom of lower housing 14, but not shown in FIG. 1, is a door for providing access for insertion of conventional batteries, such as a nine volt transistor battery, to operate the circuitry contained within the housing halves 12 and 14 of the game 10.

In the play of the game there are shown on the display 18 two offensive men, five defensive men, and, at times, a goalkeeper. Also shown upon the display 18 is a ball. The movements of the two offensive players and the ball are controlled by use of the keys 20–29.

The Off 1-Pro-2 key 20 is used to energize the game and to select the speed at which the particular skill level the game is played. By moving the switch 20 from the Off position to the "1" position, the soccer game 10 is energized so that it may be played at the lower of two skill levels (game one) at the slowest of two speeds while by moving the key 20 to the "2" position, the game 10 is played at the lower sophistication level at high speed. In the preferred embodiment, if the score key 22 is depressed as the key 20 is moved to either the "1" or the "2" position, the higher sophistication level game (game two) is selected at either the low or high speed of play. Selecting one of the two sophistication or skill levels causes the defense to move in particular ways, changes the probability of a defense man taking over the ball when a collision occurs between the ball and the defense, and alters various other features of play.

The keys 26, 27, 28, and 29 are used to control the direction of movement of one of the two offensive players. Depression of each of these keys 26–29 causes the offensive player under control to move up, to the left, down, and to the right by one position, respectively.

The teammate key 21 is used to change control between the first and second offensive player during the play at the game two level. Control is also changed automatically in certain situations during the play of the game on both levels.

The pass key 24 is used to cause the offensive player having control of the ball to initiate a pass to the other offensive player. The shoot key 25 is used to cause the offensive player having control of the ball to initiate a shot toward the goal.

The low/high key 23 is used to select whether either a pass or a shot will be on the ground (low mode) or in the air (high mode). In the preferred embodiment, when the game is first turned on, the play proceeds in the low mode until a depression of the key 23 when the mode switches to the high mode. Thereafter, until the key 23 is again depressed during that play, the game remains in the high mode. Continued operation of the key 23 switches the mode back and forth between high and low.

The score key 22, in addition to being used to select the game two skill level as explained above, is used when the ball is not in play to perform a number of functions. It is used to clear the entire display 18 and to initiate a sequence in which the visitor's score, the home team's score, and the time remaining in the current half of play are shown in order. Following this sequence, the normal game display is shown.

The uses of the various keys 20–29 in the play of the soccer game 10 will be more completely explained in the following description.

Figure 2:
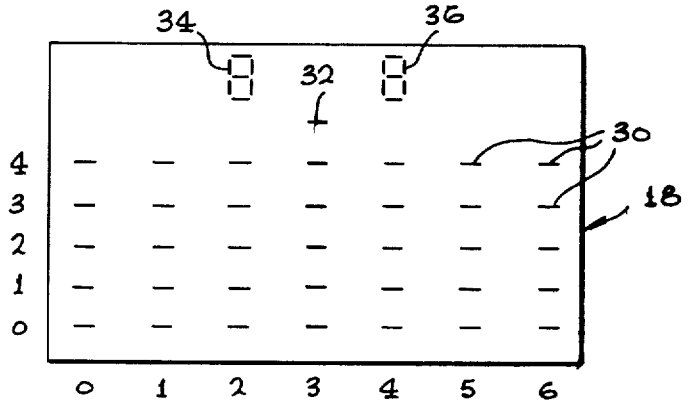
FIG. 2 is a diagram illustrating an arrangement by which information is presented on the display of the housing shown in FIG. 1 in a preferred embodiment.
Figure 3A:
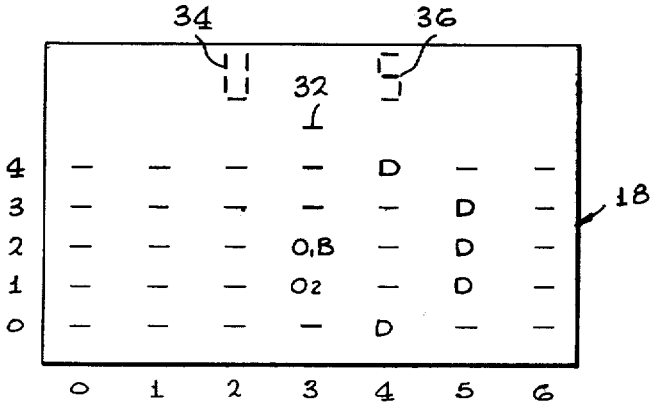
FIGS. 3(*a*)–3(*e*) illustrates different positions assumed by characters on the display illustrated in FIG. 2.
Figure 3B:
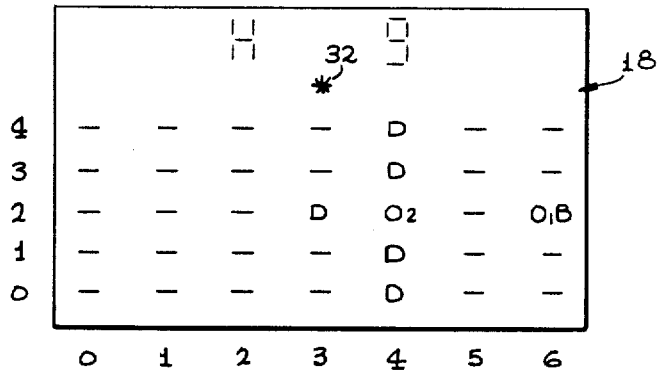
Figure 3C:
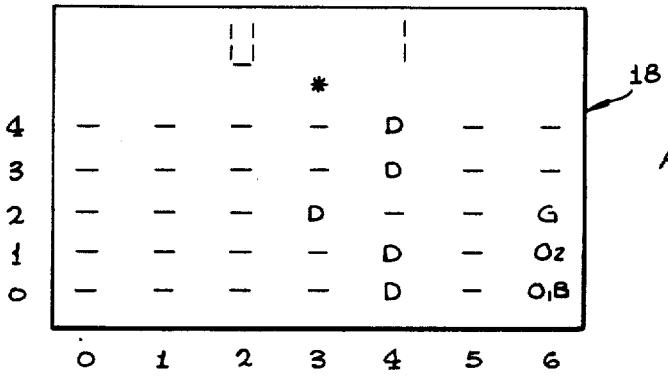
Figure 3D:
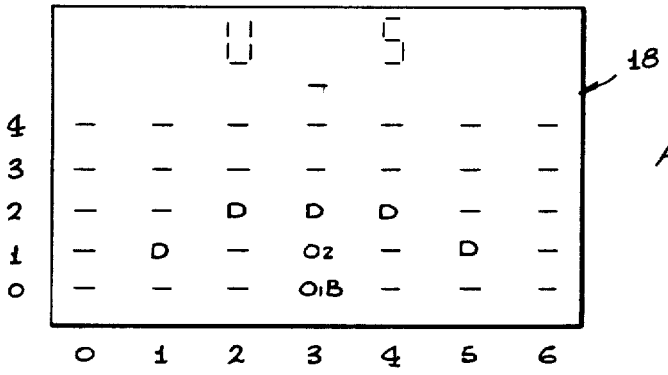
Figure 3E:
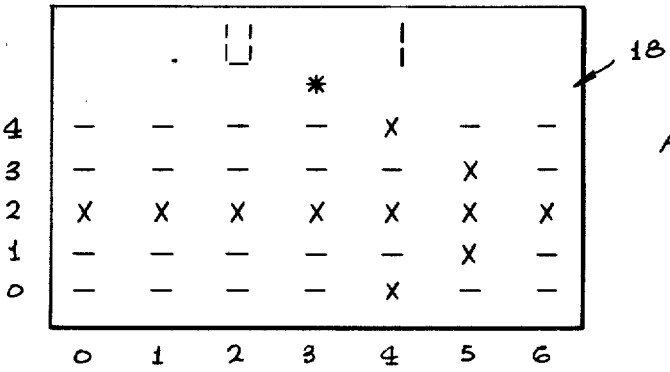

Referring now to FIG. 2, the display 18 is shown in more detail. The display 18 may comprise in the preferred embodiment an arrangement of five rows and seven columns of light emitting diodes (LEDs) 30. For convenience, the rows of LEDs 30 are designated 0, 1, 2, 3, and 4 from the bottom up while the columns are designated zero through six from left to right. The display 18 also comprises in the preferred embodiment a single LED 32 positioned in column three above row four and a pair of conventional seven segment LED digits 34 and 36 arranged on either side and above the LED 32. When play is stopped, depressing the score key 22 causes the digits 34 and 36 to exhibit the scores of the home and visiting teams and time remaining as explained above.

During the play of the game, the digit 34 is lit with either an H or a U (used as a "V" because of the limitations of LED digits) to indicate whether the home or visitors' team is on offense. When the home team is on offense the attack proceeds from right to left with goals by the home team being scored by attacking a goal at the left of the display 18. When the visitors are on offense, the attack proceeds from left to right with goals being scored by the visitors at a goal at the right of the display 18.

The field shown in display 18 is, in the preferred embodiment, but one of nine individual essentially identical sections or zones which are displayed in sequence proceeding from the home defensive goal at the right to the visitors' defensive goal at the left. In other words, if the ball were to move from the home defensive goal at the right to the visitors' defensive goal at the left (in the preferred embodiment), it would proceed from column 6 to column 0 through a first zone, would then reappear in column 6 and proceed to column 0 of a second zone, and would continue in a like manner until it had proceeded through an entire nine zones. Each of the zones occupies the entire display 18 while the ball is positioned within that zone. The particular zone in which play is taking place at any instant is indicated by the digit 36 displaying a numeral from one through nine. If the home team is on offense, an H is displayed by LED digit 34; and the zone nearest the goal defended by the home team is indicated by the digit 36 displaying a "nine." With the home team on offense, zone nine is the farthest to the right and zone one is the farthest to the left. When the visitors are on offense, the visitors defend a goal zone at the left indicated by digits 34 and 36 as "U9" and attack a goal zone at the right indicated by "U1." The zones between one and nine are numbered in order progressing from left to right or from right to left depending on which team is in control of the offense. In addition, the LED 32 is used as an end zone indicator and is lit when play is taking place in either zone one or zone nine. In this way, an operator is made aware of the approach of the goal at either end of the field.

The remaining LEDs 30 in the rectangular array of rows and columns are used to indicate the positions of the offensive and defensive players and of the ball. Defensive players are indicated by dimly lit LEDs 30 while the offensive players and the ball are indicated by brightly lit LEDs 30. The offensive players and the ball are distinguished (in the preferred embodiment) by causing the ball to blink on and off at a fast rate, the offensive player which is controlled by the operator to remain on constantly, and the offensive player which is controlled by the control circuitry of the game 10 to blink at a slower rate (one-half) than the ball.

Referring now to FIG. 3(*a*), the positions of the players and the ball on the field are shown when the game is first turned on at the game one skill level. In FIG. 3, a B is used to indicate the position of the ball, $0_1$ is used to indicate the offensive player controlling the ball, $0_2$ to indicate a second offensive player, a D is used to indicate a defensive player, and a dash is used to indicate a space containing an unlit LED 30. In certain of the drawings, G indicates a goalkeeper.

As explained above, the game is energized at the game one level by sliding the key 20 to position "1." The initial position of the players on the field is shown in FIG. 3(*a*), and it will be noted that the offensive player $0_1$ has the ball at his position. At this level of play, the teammate key 21 and the low/high key 23 are not functional. Furthermore, the shoot key 25 is enabled to allow shots only in the goal zones ("U1" for the visitors and "H1" for the home team). It should be noted that when the game 10 is first turned on at all skill levels, the digits 34 and 36 display "U5" which is the zone in the center of the field. In the preferred embodiment the game 10 automatically goes into the visitors' offensive mode upon initially being turned on and in the home offense mode when second half of play starts.

The four keys 26, 27, 28, and 29 control the movement of the offensive player $0_1$ and the ball B which travels with the offensive player $0_1$ until a pass or a kick occurs. Whenever the offensive player $0_1$ and the ball B occupy the same space, they move together under control of the switches 26–29 until a shot is taken or a pass is made. By moving any of the switches 26–29, the offensive player $0_1$ and the ball are moved one space in the direction indicated by the particular switch 26–29.

While the player $0_1$ is normally moved by the keys 26–29, the second offensive player $0_2$ is moved automatically by the control circuitry of the game 10 in most circumstances. Play is initiated from the kickoff formation shown in FIG. 3(*a*) by depressing the key 24 causing the player $0_1$ to pass the ball B. The offensive player $0_2$ does not begin to move automatically until after a pass so that the player $0_2$ cannot move off sides on the kickoff. When the defensive player $0_2$ does move automatically, it does so at the rate of one move per second (in the preferred embodiment). Its movement direction is toward the end of the farthest diagonal in front of the offensive man $0_1$ but not beyond the last column in the zone in the direction the offensive man $0_1$ is headed. Thus, if the offensive man $0_1$ is in one of the bottom two rows, offensive man $0_2$ starts for the top while, if the offensive player $0_1$ is in one of the top two rows, the offensive player $0_2$ starts for the bottom row. If the offensive man $0_1$ is in the center row, the offensive player $0_2$ heads for either the top or the bottom row depending on the zone; in the center zone five and in other odd numbered zones, it heads for the top row while in even zones of the field, it heads from the bottom row. In this manner, offensive player $0_2$ attempts to line up for a diagonal pass in the forward direction from the player $0_1$. The offensive player $0_2$ moves automatically one spot toward the target selected.

If the target position selected for the man $0_2$ is not directly horizontal or vertical, from the player $0_1$, a random selection is made therebetween with each having an equal chance. If the initially selected move is not possible, an alternate move is selected on the following basis: if the attempted move was left, the alternates are selected in the order down left, up left, down, and up; if the attempted move was right, the alternate moves are selected in the order down right, up right, down, and up; if the attempted move was down or up, no alternate moves are selected. If none of the alternate moves are possible, the offensive player $0_2$ does not move automatically on that particular cycle.

A kickoff starts with a pass in game one and with either a pass or a shot by the offensive man $0_1$ in game two. The keys 26–29 do not control offensive man $0_1$ during kickoff but may be used in game two for maneuvering the offensive man $0_2$ into position to receive a pass. This method of proceeding is consistent with to soccer rule requiring a second player to touch the ball before it is in play. The automatic motion of the offensive player $0_2$ is, consequently, disabled on the kickoff when a pass may be made to the offensive man $0_2$. If the ball B is passed and encounters the offensive player $0_2$ at some position, the offensive man $0_2$ takes control of the ball and becomes offensive player $0_1$ controlled by the keys 26–29. In such a case, the indication on the display 18 changes as the pass is initiated so that offensive player $0_2$ becomes offensive man $0_1$ and offensive man $0_1$ becomes offensive man $0_2$ and moves automatically thereafter as described above.

A pass from offensive man $0_1$ to offensive player $0_2$ takes place either horizontally, vertically, or diagonally. If offensive player $0_2$ is not directly lined up on one of these lines, the pass is made diagonally toward the general direction of offensive player $0_2$. The length of a pass in game one is seven spaces so that it will be complete, go out of bounds, or hit a defender D.

A pass goes out of bounds so that a throw-in is required if a loose ball crosses the top or bottom boundaries. It a pass goes out of bounds, play of the game 10 is stopped; a whistle sounds; and upon depression of the score key 22, the display 18 is set up for a throw-in as shown in FIG. 3(*d*). The offensive team on a throw-in play is that team which did not touch the ball last prior to its going out of bounds. A throw-in starts with a pass or a shot. Consequently, the direction keys 26–29 are disabled (except that they may be used for moving the offensive player $0_2$ into position in game two).

In the throw-in formation, the ball B appears on the display 18 at the position where it left the field and the offensive player $0_1$ is moved to the same spot. Offensive player $0_2$ is moved to the next spot toward the center row in the same column. The five defenders D are set up in a semicircle around the two offensive players with no defender D occupying a spot directly next to offensive player $0_1$ either vertically, horizontally, or diagonally. It is to be noted that the positions of the defenders D change to some extent as the throw-in approaches either corner of the field from the position shown in FIG. 3(*d*). If the ball B leaves the field at the top, the positions shown in FIG. 3(*d*) are mirrored about row two of the display 18.

As explained above, when a pass takes place, the control of the offensive player by means of the keys 26–29 switches automatically from offensive player $0_1$ to offensive player $0_2$ so that offensive player $0_2$ may move to receive the ball B and thereafter may control it. The display 18 thereafter shows the player controlled by the keys 26–29 as player $0_1$ and the other player as player $0_2$. In a pass or shot situation in which a loose ball B is rebounded by a defender D, control must be switched back from the receiver to the offensive player $0_1$ who made the pass or shot and to which the ball B is being rebounded so that it may again control the ball B.

It should be noted that during a pass on the ground (which is the only pass which can take place on the game one level of skill), the defensive players D cannot move. Each defensive player D, however, may intercept any ball B which collides with it. It should also be noted that the offensive player $0_2$ cannot move over either the right or the left boundary of a zone at any time, only the player $0_1$ carrying the ball.

In both games one and two, the initial depression of the pass key 24 (or of the shoot key 25 in game two) starts play of the game 10 and the movement of the defenders D. In the preferred embodiment, the defenders move automatically under control of the data processing circuitry one space per move at one second intervals between moves at the slow speed level on both the game one and game two skill levels, and at one-half of a second intervals between moves one at the fast speed level on both of the game one and game two skill levels. At most, one defender D moves during each interval. The selection of the particular defender D which moves is random with a twenty percent probability of it being any one of the particular five defensive men D in any zone other than zones "H1" and "U1." In the "H1" and "U1" zones, the goalkeeper G is also displayed on the screen of the display 18 and the probabilities of movement change. With the goalkeeper G displayed, the probability is three-out-of-eight that the goalkeeper G will move and one-out-of-eight that any one of the other five defenders D will move.

Once the particular defender D to move has been chosen, the move for that defender D is selected. To this end, a test is made to see whether the defender D is within one vertical or horizontal space from the ball B. If so, in fifty percent of the cases the defender D moves toward the ball B. If the ball B is not within one space, a test is made for the selected defender D to see whether there is more than one defender D in his particular row. If there is more than one defender D in that row, at least one other row must be unprotected; and an attempt is made to move the selected defender D vertically to the nearest unprotected row. If this attempt fails because of the position of the selected defender D, no move is made in this interval.

If the selected defender D is alone in its row, the probability of its moving is selected based on its absolute distance (the sum of the vertical and horizontal spaces) from the ball B. The closer the defender D is to the ball, the more likely it is to move, as shown in this table:

| Distance from the ball | Probability |
|---|---|
| 2 | 1 out of 1 |
| 3 | 1 out of 2 |
| 4 | 1 out of 3 |
| 5 | 1 out of 4 |
| 6 | 1 out of 5 |
| 7 | 1 out of 6 |
| 8 | 1 out of 7 |
| 9 | 1 out of 8 |
| 10 | 1 out of 9 |

On this probability basis, the move is made one square toward the ball B in a vertical or horizontal direction. If the ball B is not lined up directly horizontally or vertically, either a horizontal or a vertical move is made with an equal chance of either occurring.

The effect of using this probability basis for moving the defenders on the display 18 is that the defenders move faster when closer to the ball B and, conversely, move more slowly or not at all when distant from the ball B.

In playing either game one or two, if the zone in which play is taking place is "H1" or "U1," the goalkeeper G is shown. The goalkeeper G remains in its own column (column 6 when the visitors are on the offense, and column 0 when the home team is on the offense) and moves toward the center row unless it is already there. If the goalkeeper G is already in the center row, it moves one spot toward the row containing the ball B. The goalkeeper G never moves outside of the three spots surrounding its goal but can tackle the ball B in front of the three spots which it normally occupies (i.e., if the ball B is in spots 1, 2, and 3 of column 1 or 5). As the offensive man $0_1$ moves with the ball B and crosses an end boundary of a zone, the control circuitry adds to or subtracts from the zone number displayed so that the scoreboard comprising the digits 34 and 36 indicates the zone in which the game is currently being played. When the offensive man $0_1$ with the ball B moves over the goal line (e.g., column six in zone "U1") a number of different things may happen. If the action occurs in any of rows zero, one, three, or four, the ball B is carried out of bounds, play stops, a whistle sounds and this calls for a goal kick by the goalkeeper G of the defensive team and for the teams to switch between offense and defense.

A goal kick is set up as shown in FIG. 3(*b*) by depressing score key 22. In FIG. 3(*b*), the change from visitor's offense to home team offense is shown with the goalkeeper G having become the new offensive player $0_1$ handling the ball B and the five defenders D having taken positions as shown. The second offensive player $0_2$ is lined up in row two in column four (for the home team on offense) which contains four defensive players as is shown in FIG. 3(*b*). A goal kick starts with a pass in either game or a shot in game two. Again, the direction keys 26–29 are disabled except in game two for maneuvering the second offensive player $0_2$. The scoreboard indicates H9 to show that the home team has the ball in its own defensive goal zone. An asterisk is shown below the "H" and "9" in FIG. 3(*b*) to indicate that the LED 32 is lit showing play is taking place in a goal zone.

A goal is scored by a shot crossing the goal line from a zone one into a zone zero when the ball B is on the ground and has just left row two. A score for the visitors' team will have just left column six, and a score for the home team will have just left column zero of the particular zone. This allows both horizontal and diagonal scoring. The positions from which goals may be scored on the home team are indicated by "Xs" in FIG. 3(*e*).

A shot is initiated by pressing the shoot key 25. At the game one skill level, depressing the key 25 causes a shot of seven spaces. However, a shot can only be taken in the offensive goal zones in playing game one. Depressing the shoot key 25 causes the ball B to separate from the player $0_1$ and to proceed in the general direction of the goal from the position of the offensive player $0_1$ at the time of the kick. Once the ball B starts to move on a shot or a pass, it moves one space (directly or on a diagonal) in the direction of the target every one-half of a second. If the game 10 is in the low mode (as it always is at the game one level), the ball B is stopped by any collision with either an offensive player $0_1$ or $0_2$ or a defensive man D. In the game one mode, a loose ball B which has no more moves left after a shot or a pass has been initiated is usually rebounded by the first defensive player D to touch the ball to the offensive player $0_1$ although on occasion it will be taken over by the defensive player on an inbounds turnover. If a loose ball B collides with an offensive player, the ball B is taken by that offensive player and is indicated as possessed and in control by that player by making that player the player $0_1$.

If a defensive man D and the ball B during a shot or pass collide or if the defensive man and the offensive player $0_1$ carrying the ball B collide, the ball B is put into play (if it is not already) and one of two actions takes place, either an inbounds turnover to the defensive man D causing the defensive team to become the offensive team or a kick by the defensive man D. The probability of a turnover in speed one is one in sixteen and at speed two is one in eight. If the ball B is not turned over on a collision to the defensive man D, the ball B is rebounded to the shooter $0_1$ at the game one skill level and is kicked away at the game two skill level.

When an inbounds turnover takes place, play is stopped, a whistle sounds, and the move in progress is terminated. The defensive man D or goalkeeper G with which the collision occurred is changed to become the new offensive player $0_1$. By pressing the score key 22, the display 18 resets for an inbounds turnover play.

An inbounds turnover play is set up on the display 18 by automatically moving the new offensive man $0_1$ to the spot where the ball B was when the collision occurred and then rotating all of the players and the ball B from their old positions (player $0_1$ from its new position) about an axis running through column three to new positions mirroring the old. This has the effect of providing the new offensive man $0_1$ an equally difficult or equally simple situation as that faced by the previous offensive player $0_1$.

If a defensive player D defending its own goal kicks the ball out of any row in its goal zone, a corner kick must be set up. In order to initiate a corner kick after the ball goes out of bounds and play stops, the operator presses the score key 22, and the display sets up the particular corner kick, an illustration of which is shown in FIG. 3(*c*). The kick occurs in the corner nearest the exit point of the ball B. A corner kick is set up automatically on display 18 by placing the ball B and the offensive player $0_1$ in the corner and arranging the defenders D as shown in FIG. 3(*c*). The offensive player $0_2$ is lined up in column zero or six between the goalkeeper G and the offensive player $0_1$ with the ball B. A corner kick must start with a pass or a shot. The direction keys 26–29 are used in game two during such a kick for maneuvering the second offensive player $0_2$ into position and not to move player $0_1$. The particular corner kick for which the offensive player $0_1$ kicks depends on the position at which the ball B went out.

In addition to those features of game one, the game two skill level adds high passes between offensive players, randomizes the length of passes and shots, and adds other defensive features. For example, passes and shots intercepted by the defense are not rebounded to the offensive players as in game one but are intercepted or kicked away from the offensive player $0_1$ both in and out of bounds. The defense can also score goals against the offense by kicking the ball B into the goal during play in zone nine.

During play of game two, the length of a pass is picked by the control circuitry as three, four, five, or six spaces. Furthermore, by depressing the low/high key 23 before or after play has begun, a high pass may be made between offensive player $0_1$ and offensive player $0_2$. The difference between a high pass and a low pass is that a low pass may be intercepted at any point in its progress while a high pass may only be intercepted in the first and last spaces of its travel and goes over the heads of any intervening players (offensive or defensive). A high pass also travels for seven spaces unless it encounters a sideline boundary. When a pass is made in the high pass mode, a high tone is played. During a pass in the low pass mode, a lower tone is played. Upon initiating a pass by depressing the pass key 24, a swap of the two offensive players $0_1$ and $0_2$ takes place, as explained above, so that the receiver becomes the player $0_1$ controlled by the direction keys 26–29.

The low/high key 23 can also be used in game two to generate a high shot which, like a high pass, may only be intercepted on the first or last positions. A shot is initiated by the shoot key 25 and has in game two a length randomly selected as three, four, five, or six spaces. Once the high mode has been entered by depression of the low/high key 23, the game 10 may be switched to the low mode by a second depression of the low/high key 23. The defensive men D move during a high pass, but not (as explained above) during a low pass. Although they can move into better positions during a high pass, they cannot move in such a way that they are able to intercept the ball B while it is in the air.

When the ball B is not in the air during a high pass or high shot and the defense collides with the ball B or the man carrying the ball B, or when the man carrying the ball B collides with the defense, the ball B is put into play if it is not already in play and a probability is generated to determine which of two actions to take (as explained above). The first possibility is that an inbounds turnover will occur, and at either game level the probability is one in sixteen that a turnover will occur at low speed and one in eight at high speed. If this does not occur, the ball is kicked away from the offense in the general direction of the defense's goal, that is, in the opposite direction toward which a shot made by either of those teams would be directed when on offense. This kick is toward the goal toward which the defenders D are headed but has an upward component if player $0_1$ is in row zero or one, no vertical component if player $0_1$ is in row two, and a downward component if player $0_1$ is in row three or four. A kickaway may be horizontal or diagonal (in the preferred embodiment) and has a length of one space.

In playing game two, the offensive player $0_2$ may be controlled at any time and a shot may be taken by the offense from any zone on the field rather than just from the goal zones one.

During game two, the teammate button 21 may be depressed at any time to change control from the offensive player $0_1$ to the offensive player $0_2$. This allows various maneuvers to be made on goal kicks, inbounds passes, passes, and the like which could not otherwise be made.

On all of the skill levels various sounds are made when certain actions are taken. For example, when the ball is in play, the game 10 provides a constant tick sound to simulate a game clock. At the end of a play, a whistle blows; and when the teammate key 21 has been pressed a beep is sounded. As explained above, during a pass or shot in the low kick mode a low tone is sounded while a high tone is sounded when a pass or shot is made in the high kick mode. Low and high tones are also sounded when the key 23 is pressed so that the operator knows the mode selected. When the offense enters the zone of the field in which a goal may be scored, an end zone tone is sounded. A low tone sounds when the defense kicks the ball B away from the offense, and a short buzz sounds when the ball B is loose. At the end of the first half, a double whistle sounds; at the end of the game, a triple whistle sounds. In the preferred embodiment, when either team scores a goal, a tune is played.

Figure 4:
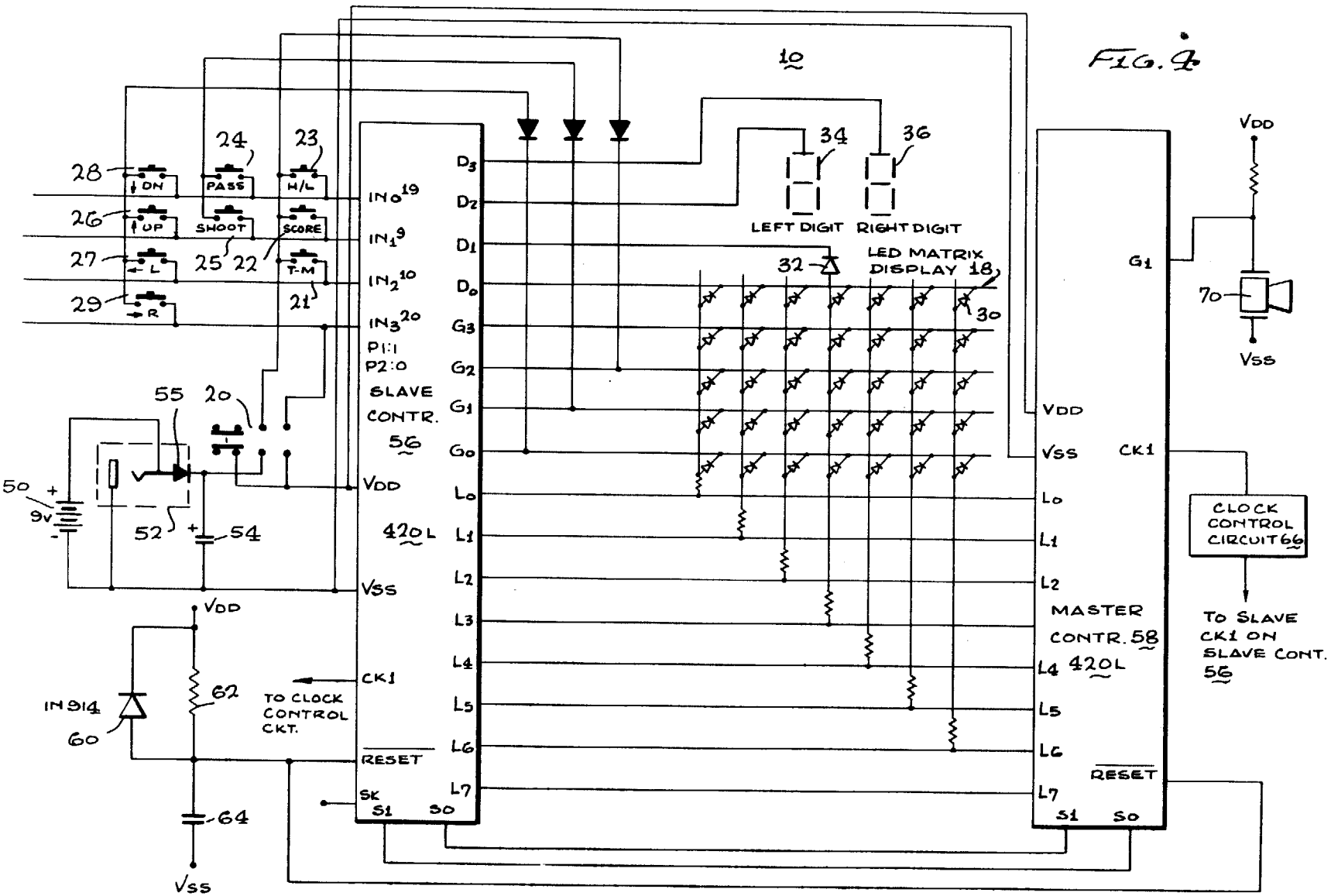
FIG. 4 is a schematic diagram of circuitry utilized in a preferred embodiment of the invention.
Figure 5A:
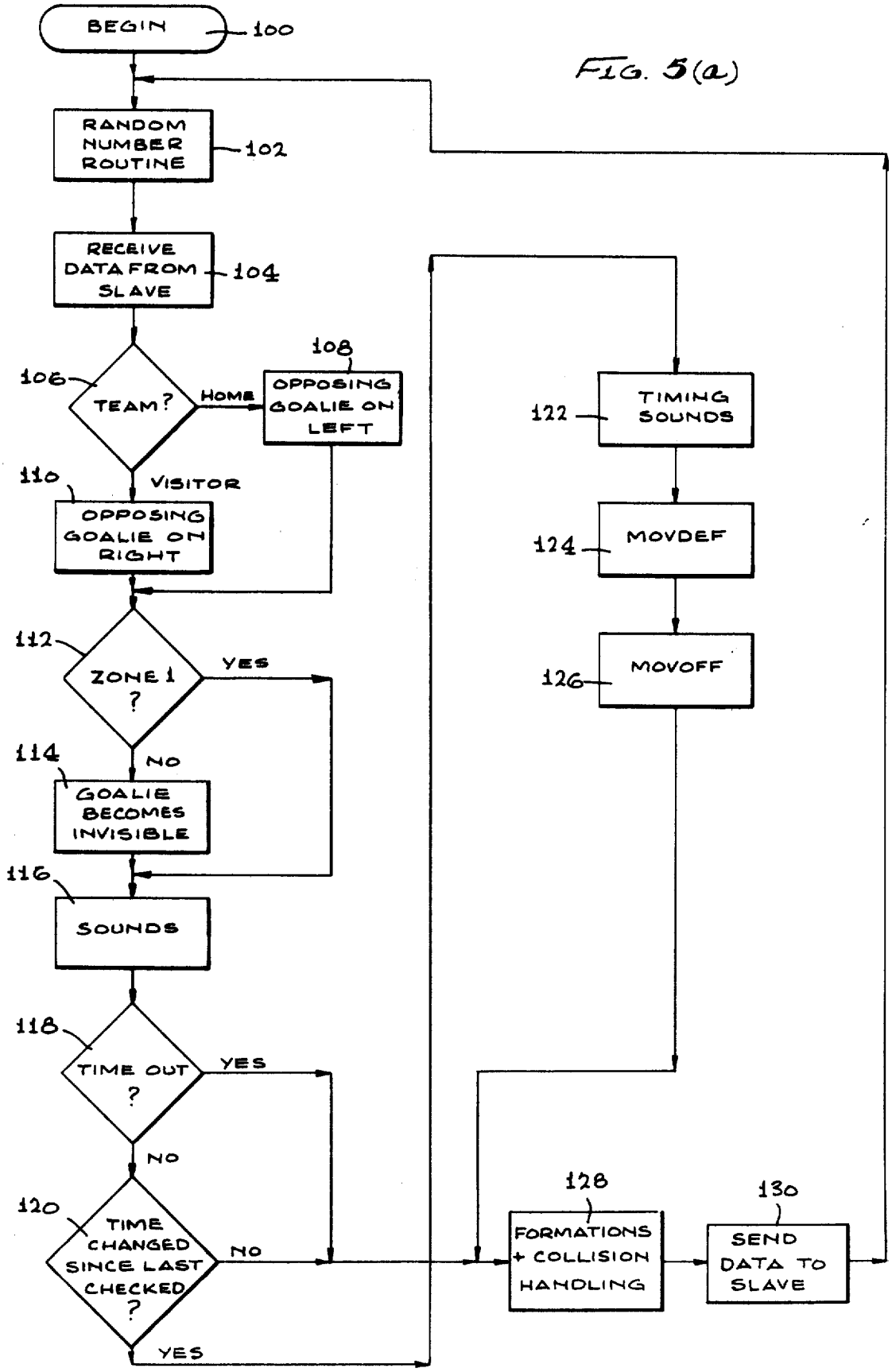
FIGS. 5(*a*)–5(*t*) together comprise a flow chart illustrating the sequence of operations performed by the circuitry of the electronic soccer game of this invention.
Figure 5B:
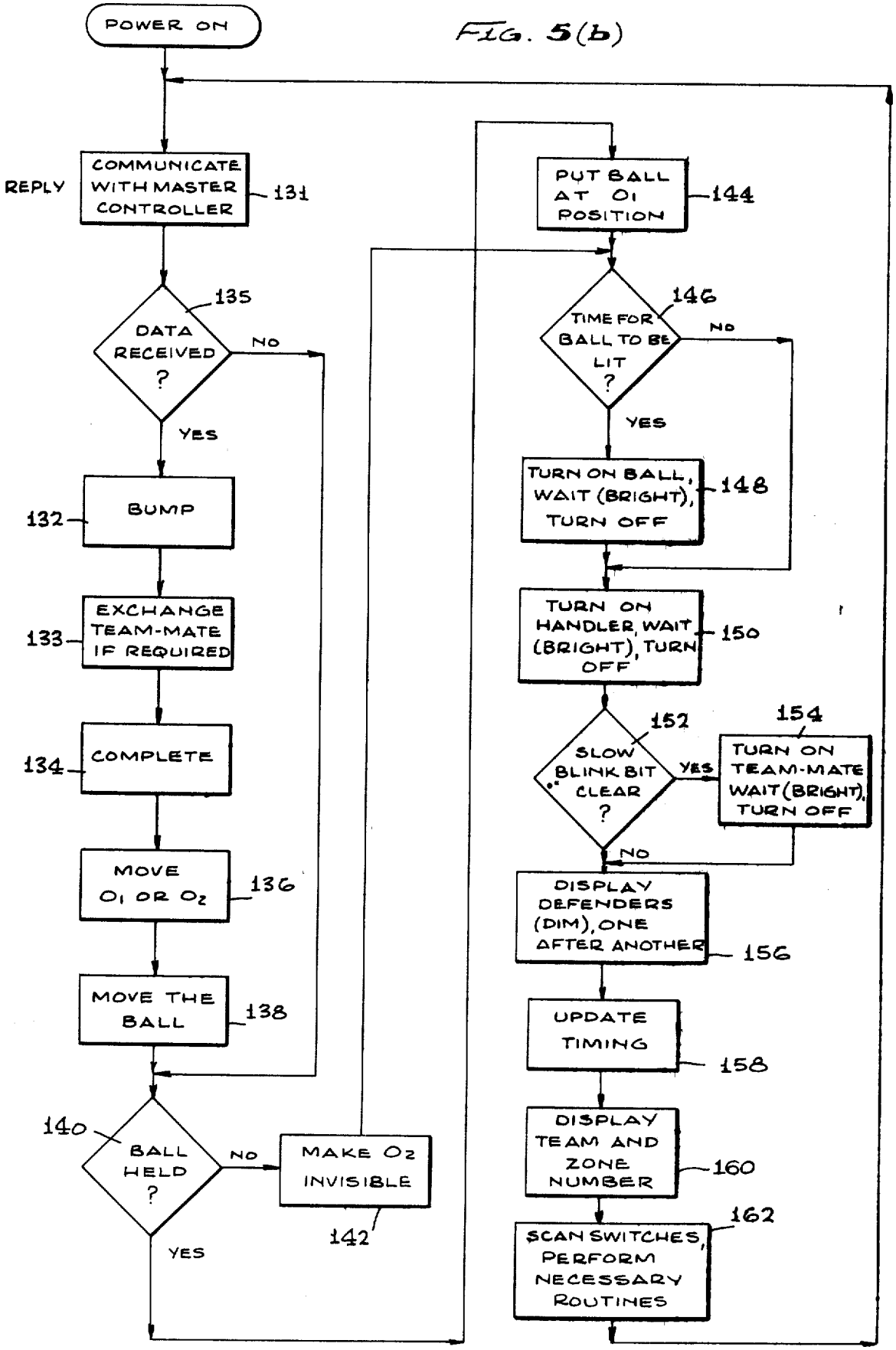
Figures 5C, 5F:
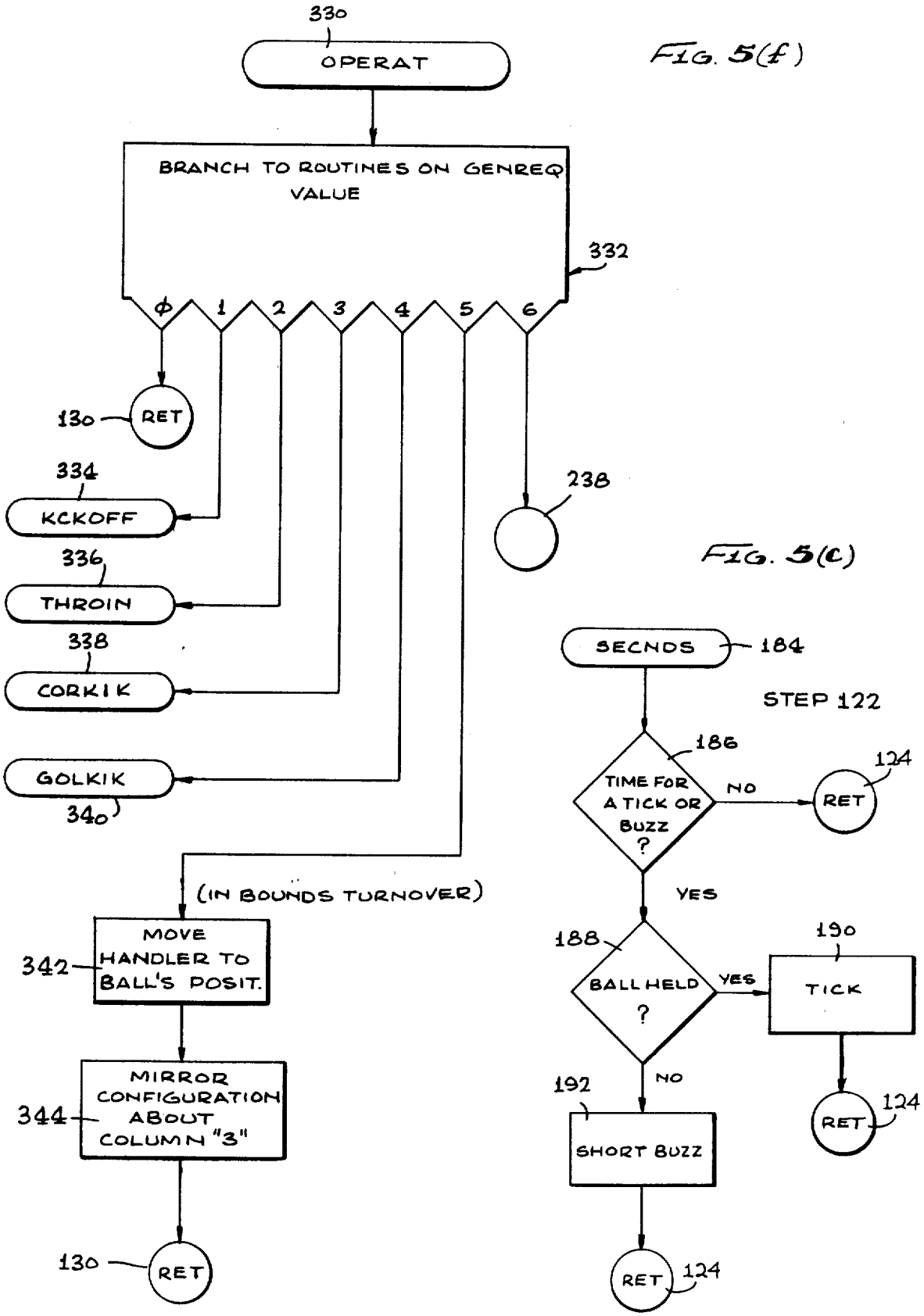
Figure 5E:
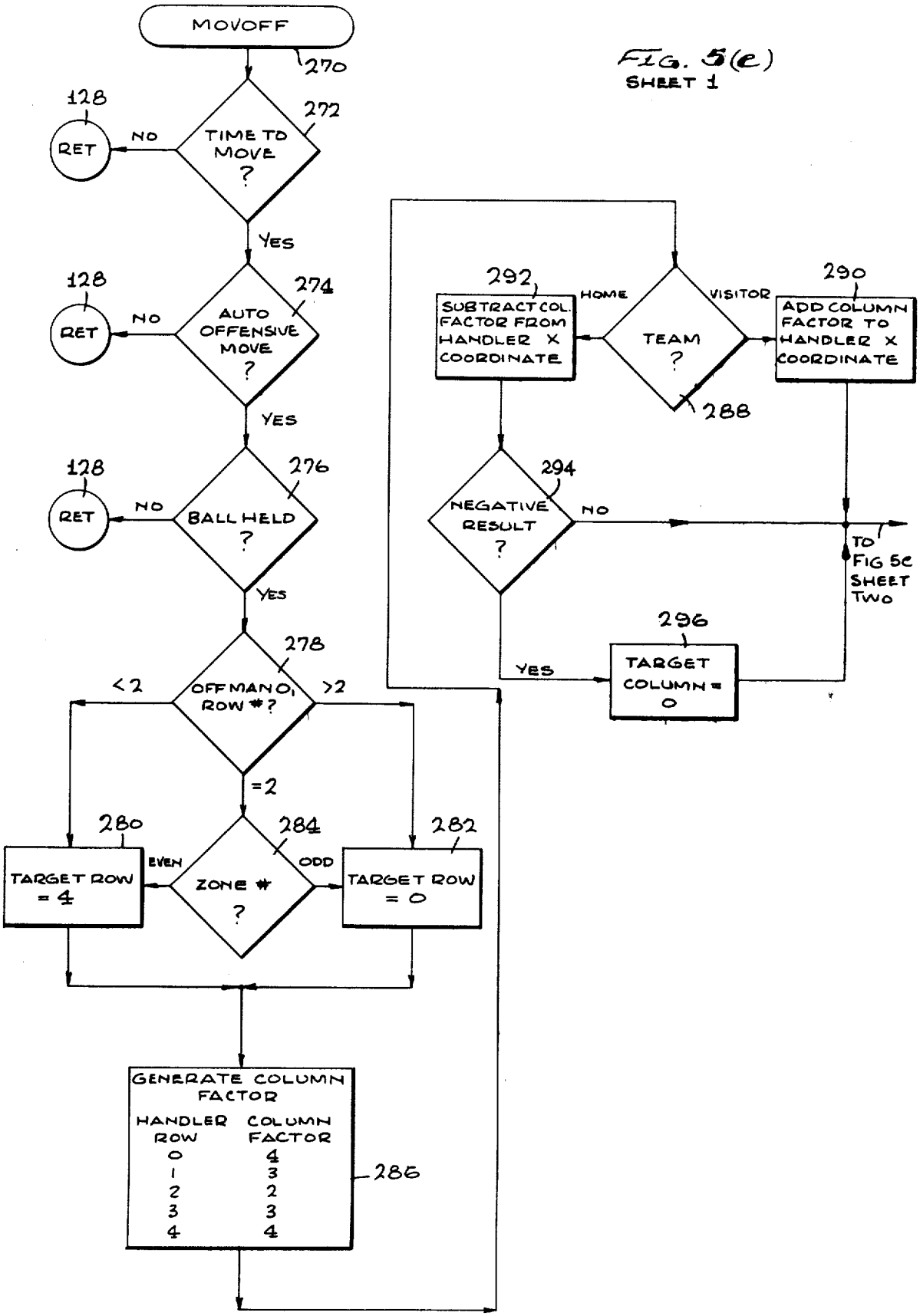
Figure 5G:
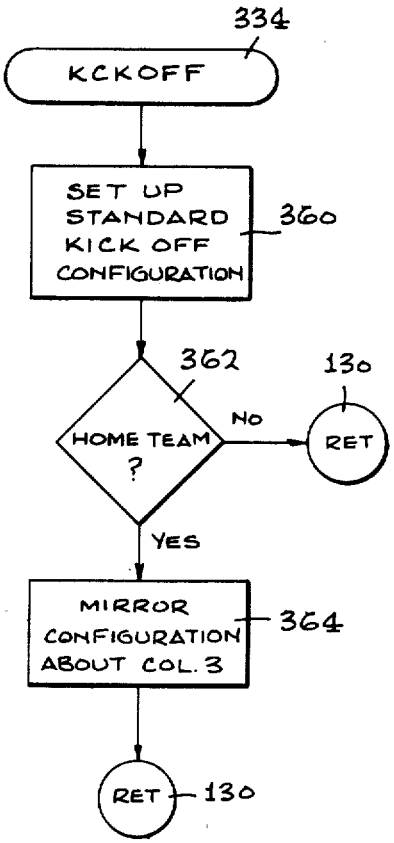
Figure 5H:
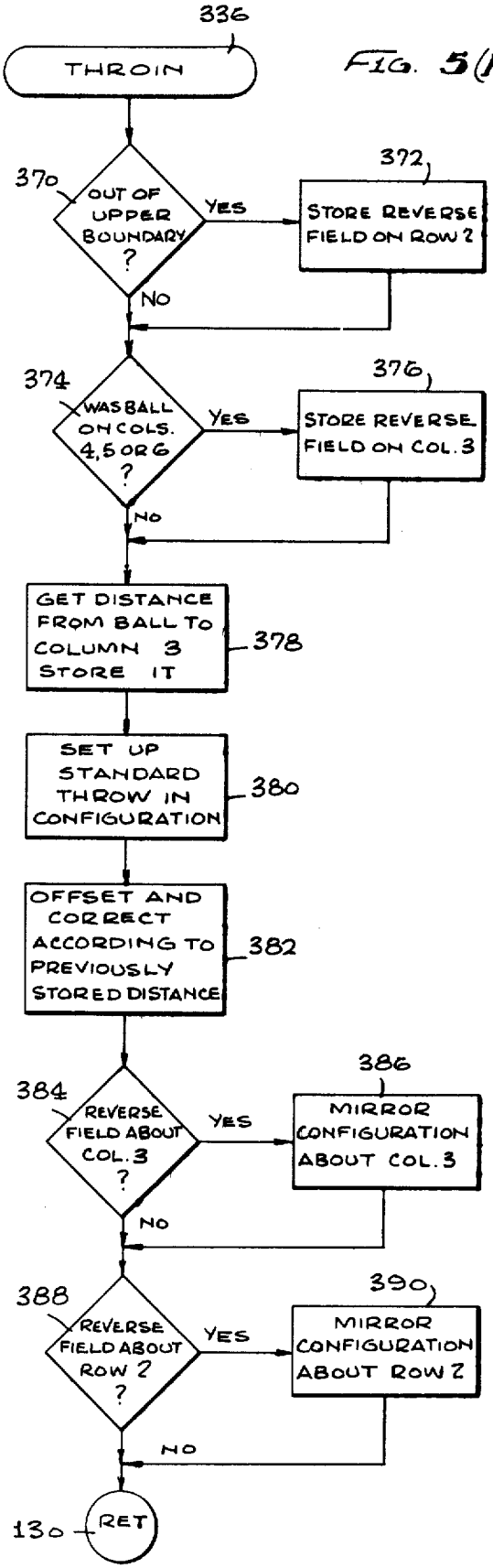
Figure 5I:
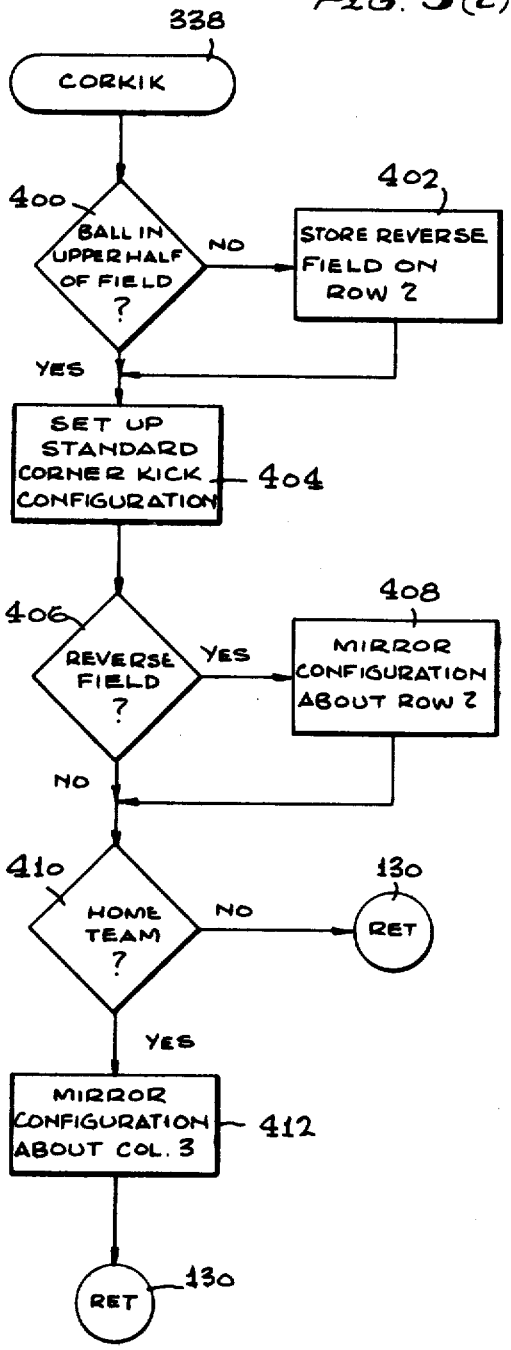
Figure 5J:
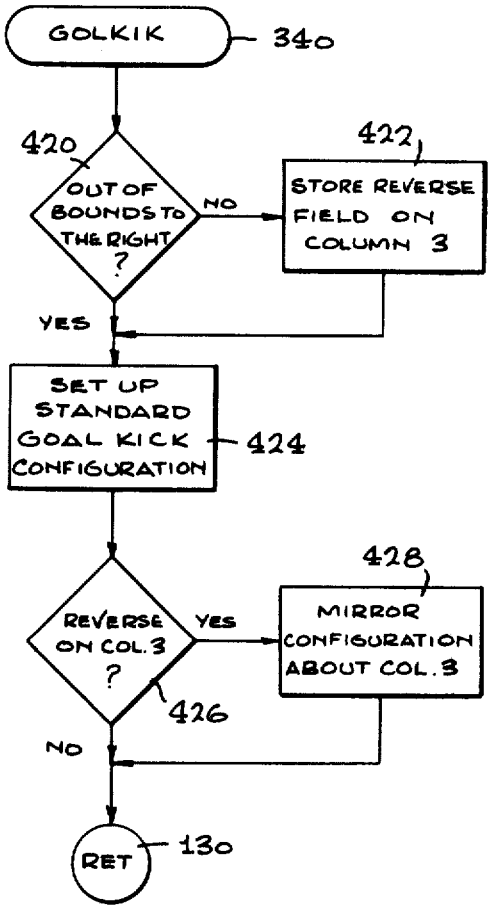
Figure 5K:
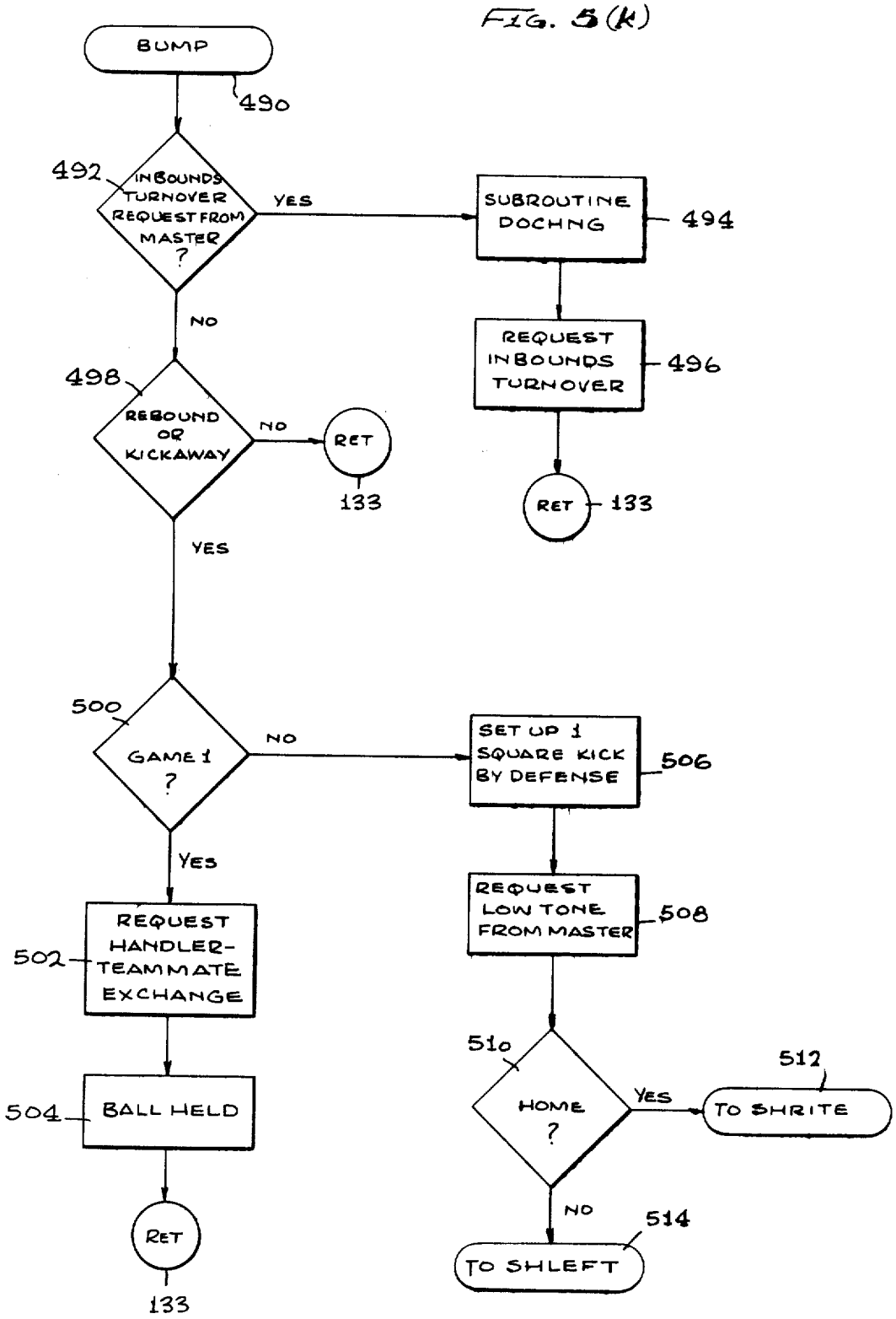
Figure 5L:
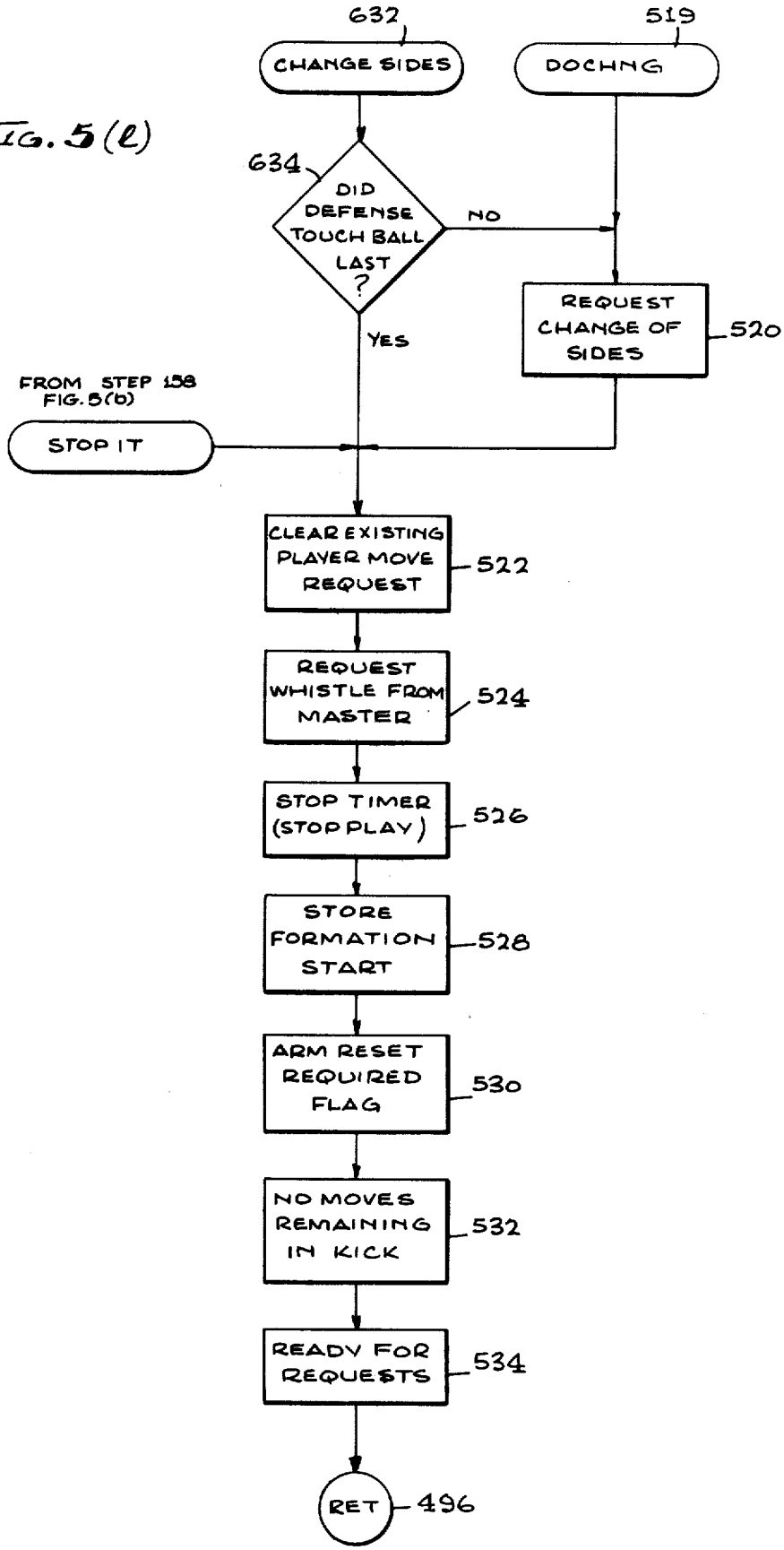
Figure 5M:
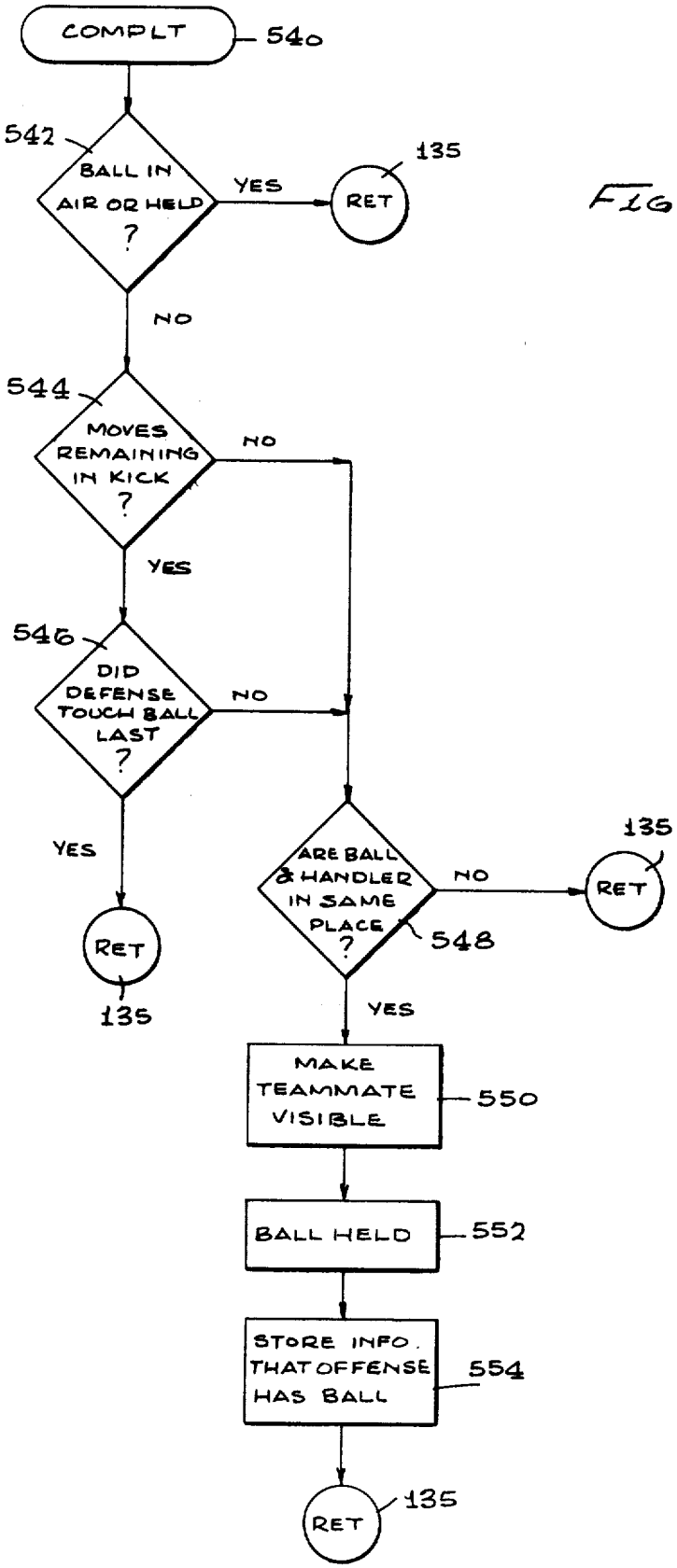
Figure 5N:
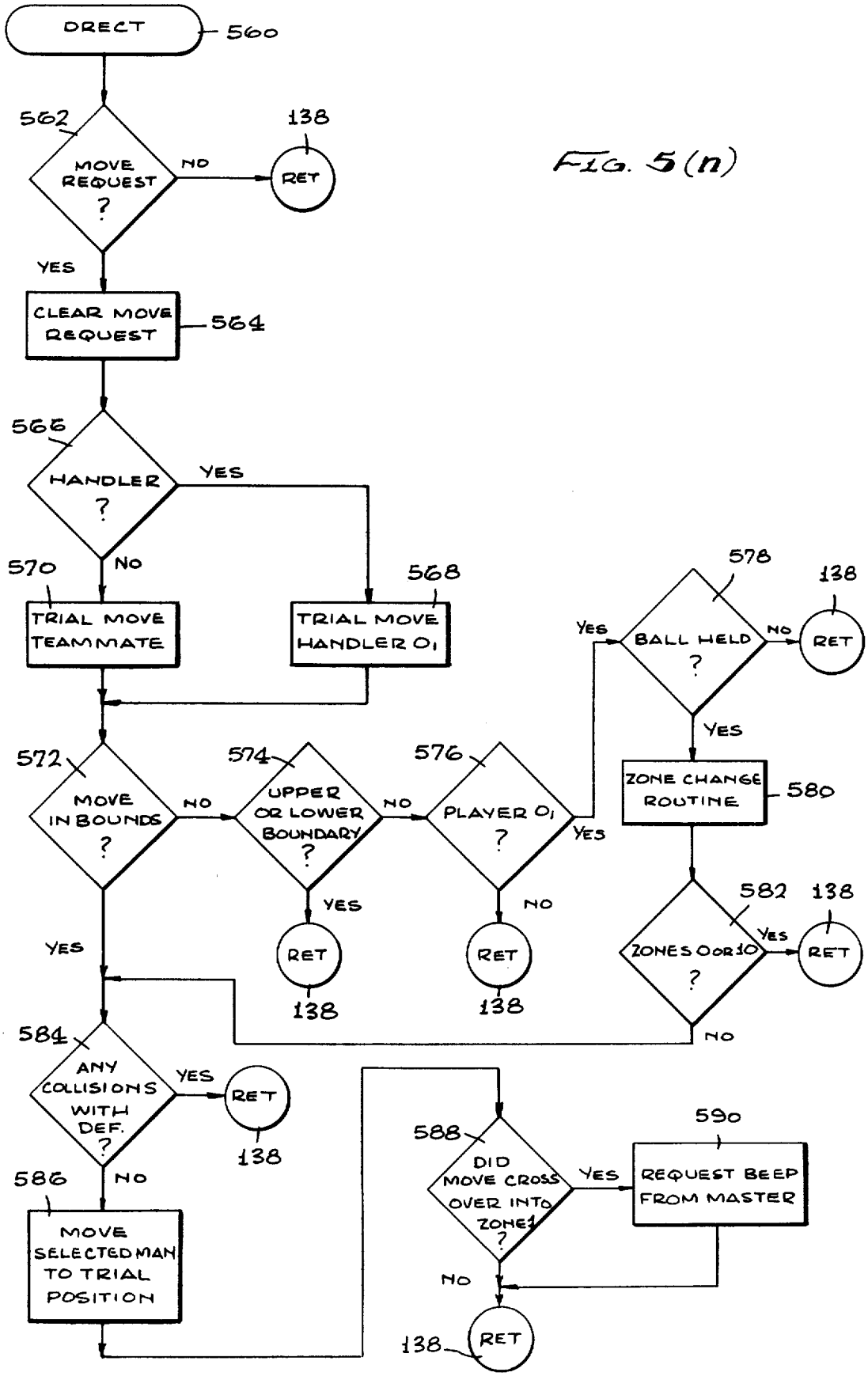
Figure 5O:
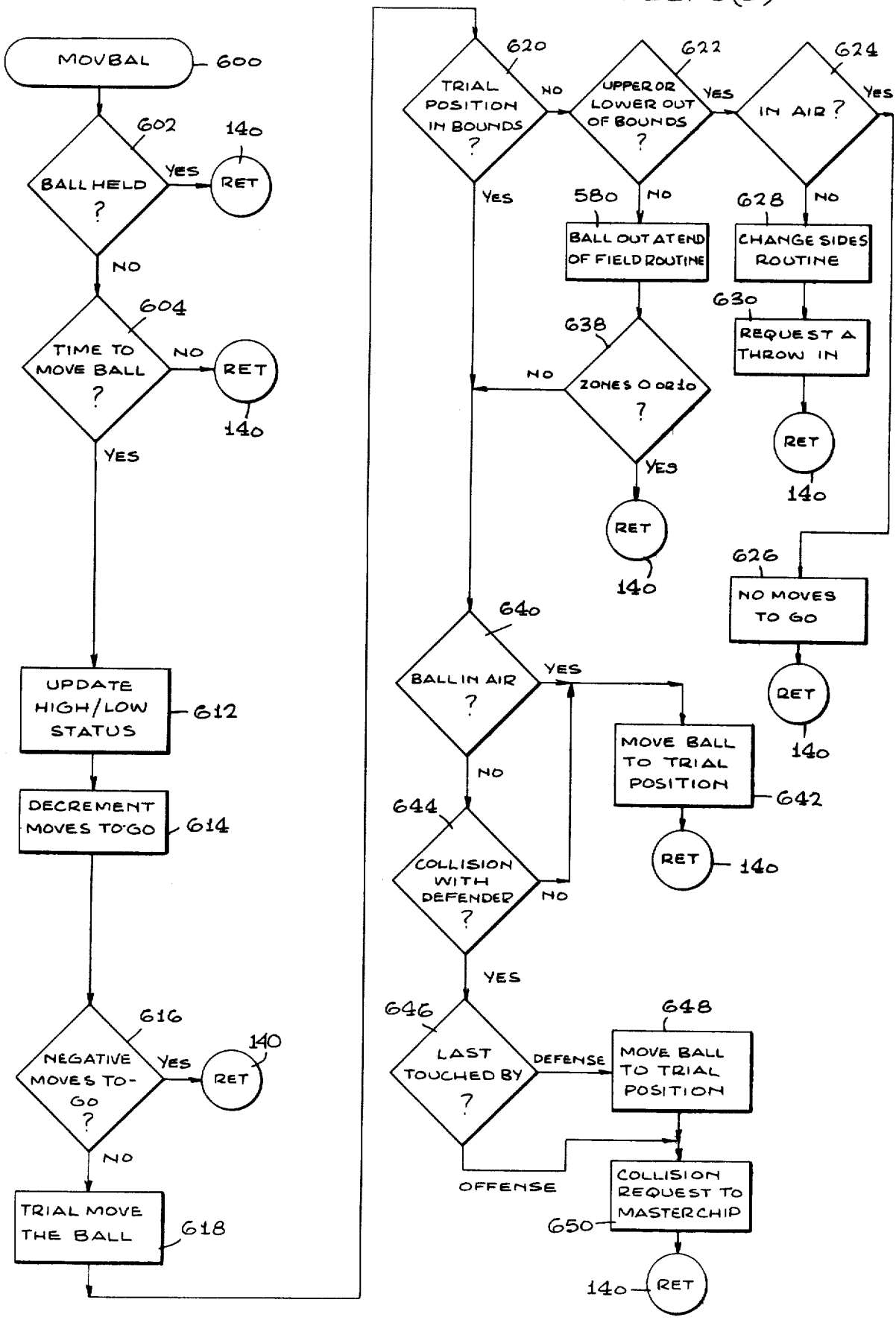
Figure 5P:
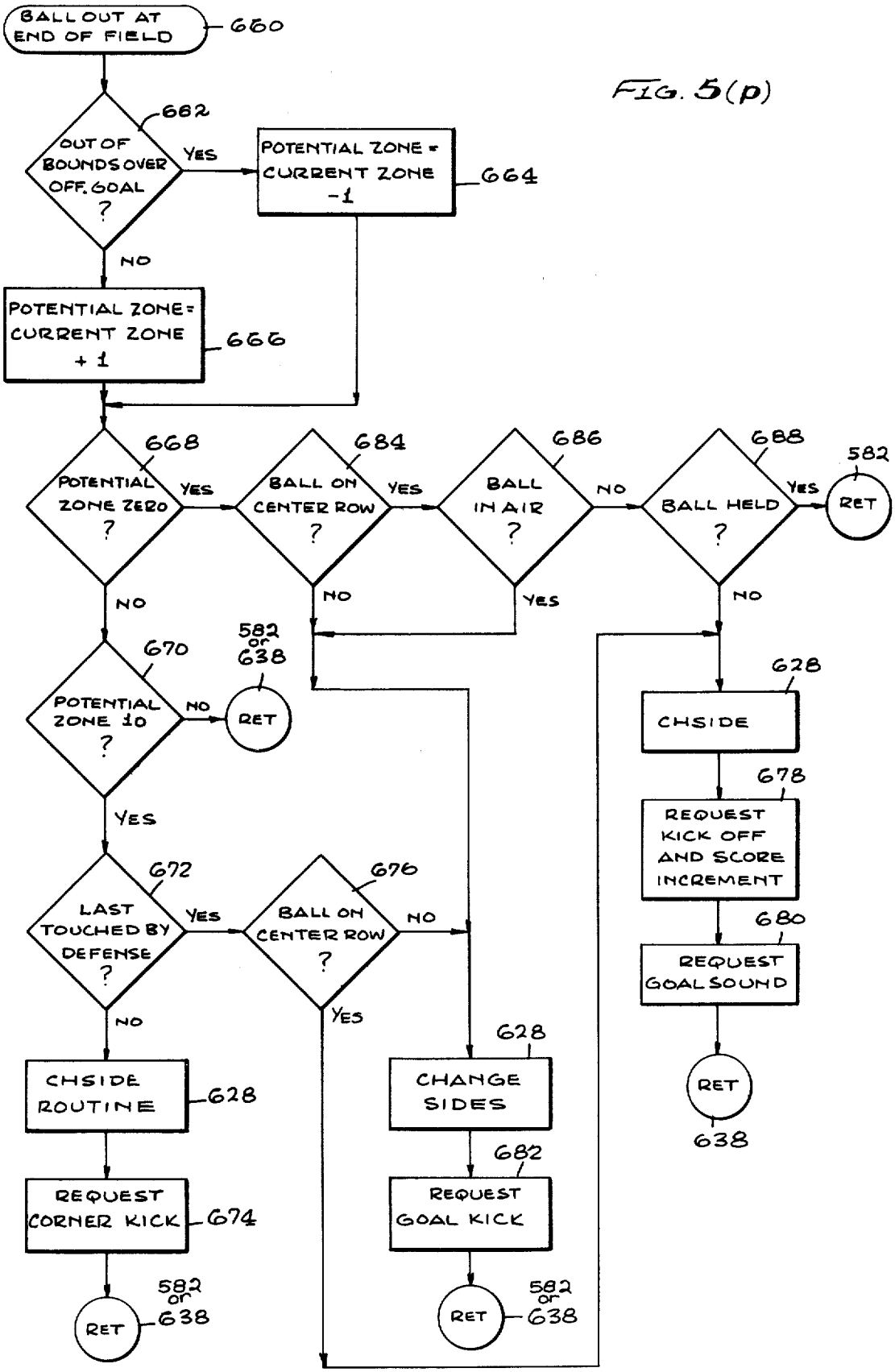
Figure 5Q:
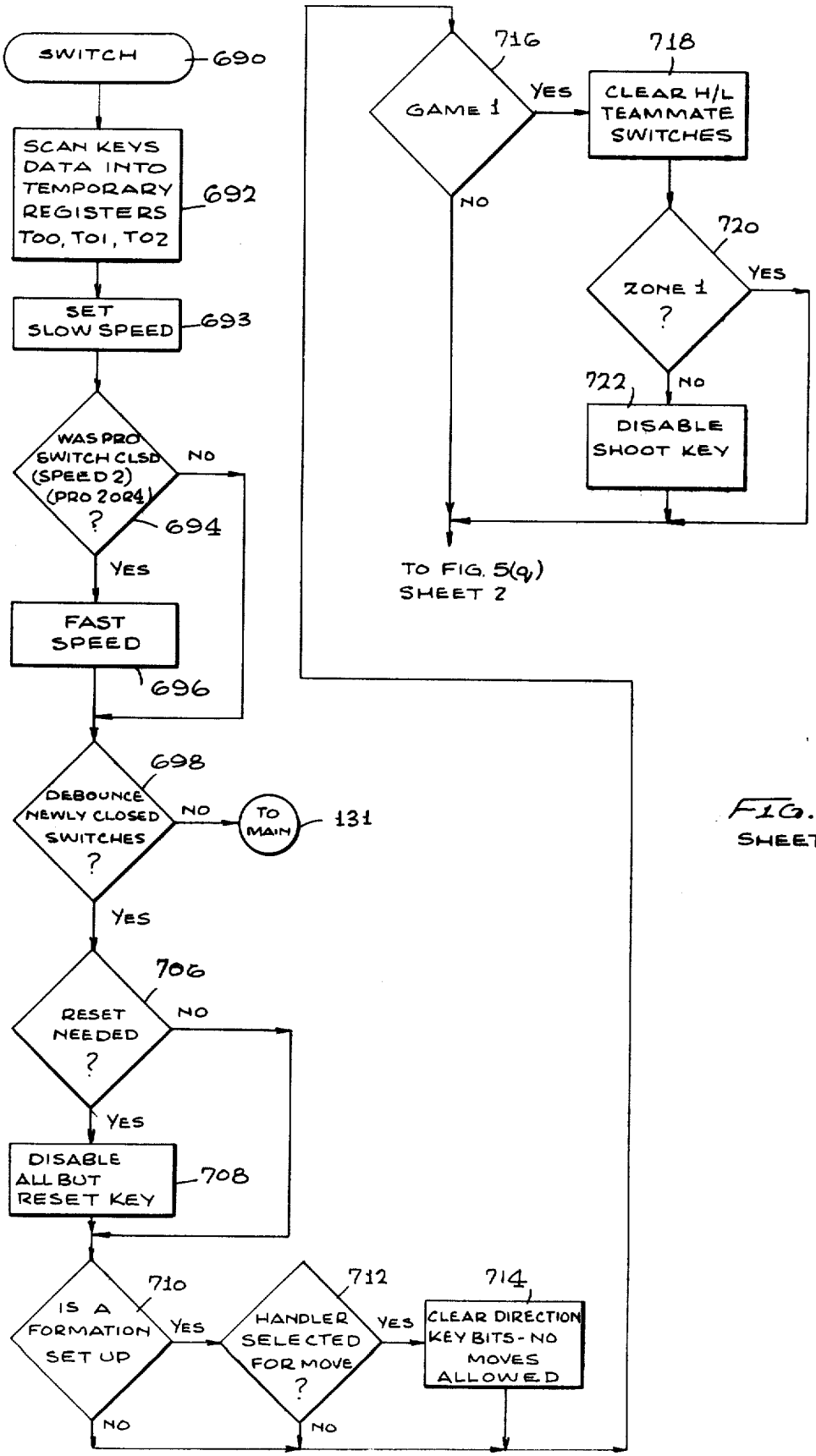
Figures 5Q, 5T:
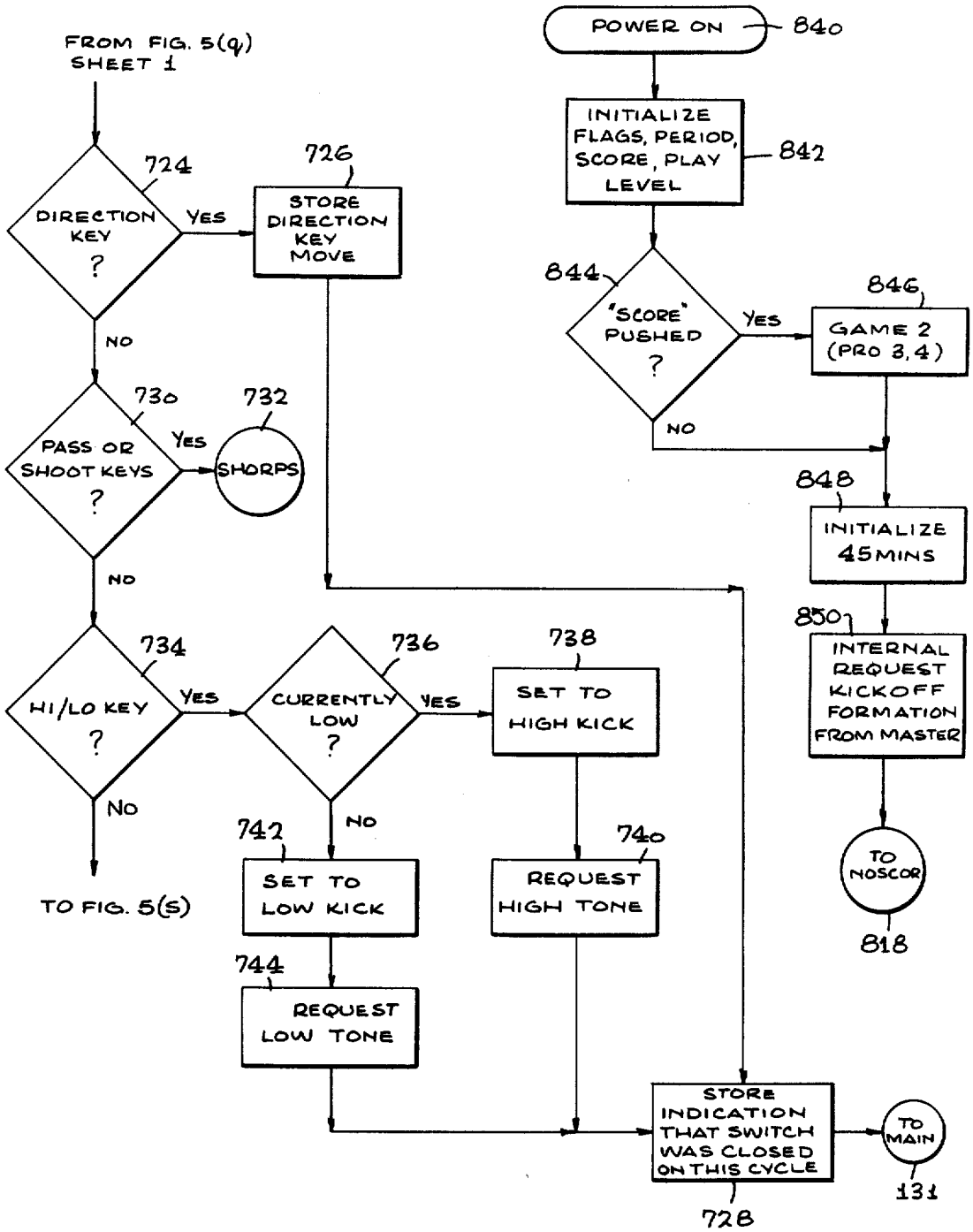
Figure 5S:
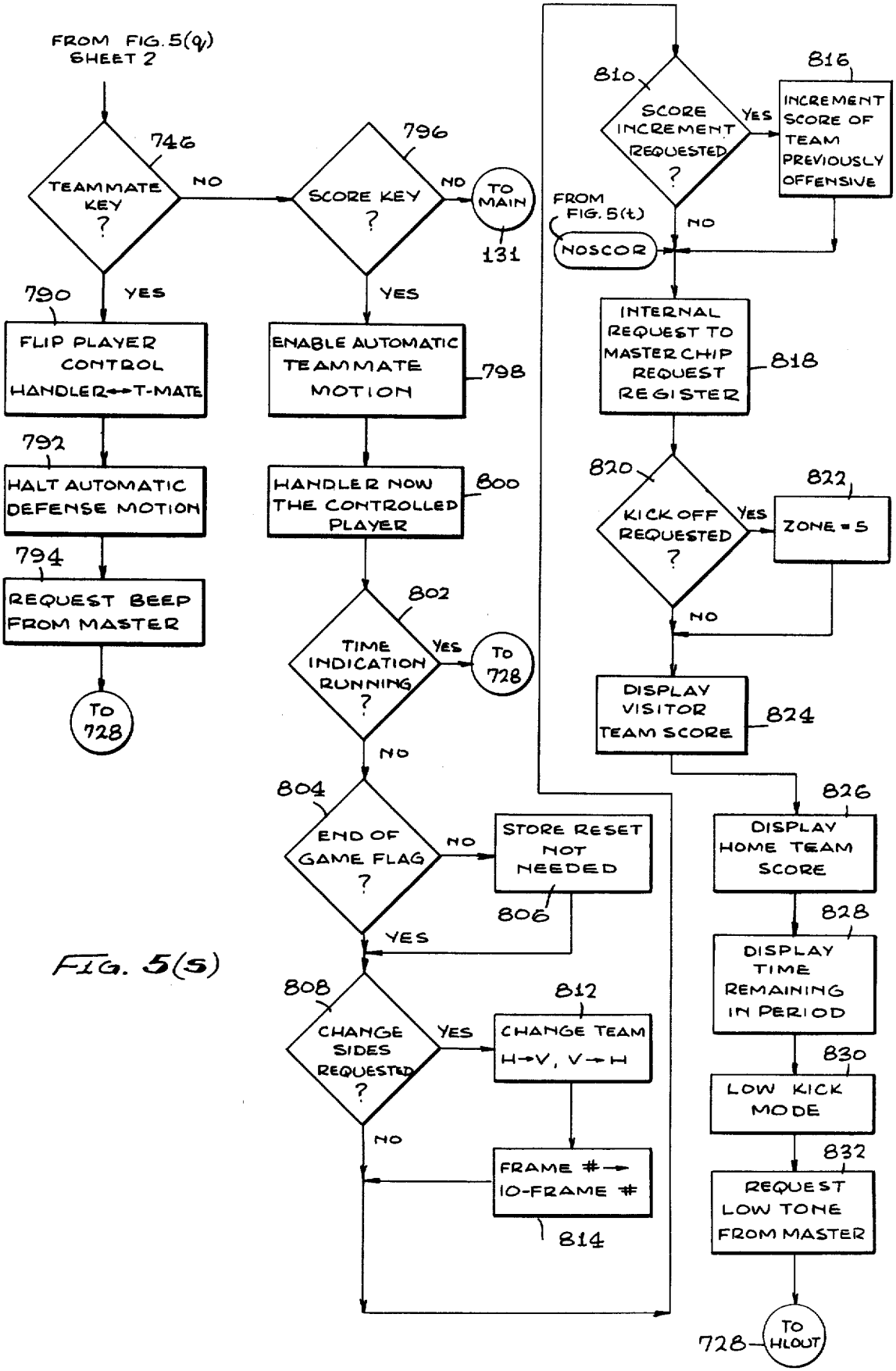

Referring now to FIG. 4 there is shown a block diagram of the circuit of the invention. The game 10 shown in FIG. 4 includes the input keys or switches 20–29. Each of the switches 21–29 is shown as a normally open switch which upon depression of a button closes a current path thereacross. The switch 20 is shown as a three-position, two-pole, make-before-break, slide switch.

Power is furnished to the game 10 from a source of DC power 50 which is connected to the switch 20 in parallel with an AC jack 52 (which allows house current to be applied through a transformer not shown) across a capacitor 54 through a diode 55. The switch 20 connects to a first slave controller 56 at terminals VDD and VSS. The switch 20 also allows the high/low key 23, the score key 22, and the teammate key 21 to be connected into circuitry leading to an input terminal $IN_3$20 in the $P_2$ position of the switch 20 and disconnected in the other positions of the switch 20.

As will be understood by those skilled in the art, the slave controller 56 may be implemented in any of a number of different ways. However, as with many prior art electronic game circuits, the preferred embodiment of the invention utilizes an integrated circuit microprocessor (a miniature digital electronic computer). Such integrated circuit microprocessors are well known and include all of the input, output, memory, logic, and control circuitry of a special purpose digital computer in miniature form. In general, such circuits have both random access memory (RAM memory) and read only memory (ROM memory). The ROM memory has connections formed by masking operations during the construction of the basic circuitry of the controller 56 to provide a completely wired circuit which includes the program for controlling the operation of the microprocessor. Such an arrangement is often described as a dedicated memory circuit. The RAM memory of the circuit is utilized for storage of the various bits of information during the operation of the circuitry.

Although many electronic games known to the prior art utilize circuitry on a single chip, the present invention utilizes two essentially identical controllers 56 and 58 which are individually masked in such a way as to provide a substantial increase in the memory capability of the game 10 over those of the prior art so that more sophisticated operations may be accomplished. As pointed out above, the controller 56 is designated the slave controller and the controller 58 is designated the master controller.

Various controller circuits (each usually produced on a single chip of material) are offered by a number of manufacturers and are well known to the prior art. A preferred embodiment of the present invention uses two COP 420L microcontrollers manufactured by National Semiconductor. This circuit is better described in the *COPs Chip User's Manual* published by National Semiconductor.

As may be seen in FIG. 4, the closure of the various keys 21-29 provides input signals at terminals $IN_0$19, $IN_1$9, $IN_2$10, and $IN_3$20 of slave controller 56. The keys 21-29 are also connected to the display 18 which, as shown in FIG. 4, comprises a number of LEDs 30 and 32 and the LED digits 34 and 36 connected in the arrangement above described. Input signals to the display 18 from the slave controller 56 are furnished at terminals $D_0$–$D_3$, $G_0$–$G_3$, and $L_0$–$L_7$. Reset pulses are provided at a reset terminal on controller 56 by reset circuitry including a diode 60 connected in parallel with a resistor 62 and to a capacitor 64. The reset circuitry is connected to the terminals VSS and VDD in order to supply power for its operation. Timing pulses are provided to the slave controller 56 and the master controller 58 at their respective terminals CKI by clock control circuit 66.

The master controller 58 provides output signals at a terminal G1 for operating a piezoelectric speaker 70. Communication with the slave controller 56 takes place on conductors connected at terminals $L_0$–$L_7$ of the controller 58. The controller 58 is also connected to the source 50 at its terminals VDD and VSS in a manner identical to the chip 56. The controller 58 receives reset pulses from reset circuitry including the diode 60 at its reset input terminal.

Referring now to FIGS. 5(*a*)–5(*t*), there are shown a number of flow charts which together constitute a flow chart representing the operation of the game 10 of the present invention. FIG. 5(*a*) describes the overall operating program of the master controller 58. The controller 58 is called the master controller because it controls communications between the controllers 56 and 58. The program is entered at step 100 and proceeds immediately to step 102 at which a random number is generated. The program then proceeds to step 104 during which data is received from the slave controller 56. The program then proceeds to decision step 106 in which a determination is made as to whether the home team or the visiting team is on offense. If the home team is on offense, the program moves to step 108 to store an indication in the RAM memory for the visitors' goalkeeper G to appear on the left of the screen of the display 18. If the visitors are on offense, the program moves to step 110 to store an indication in memory so that the goalkeeper G will appear at the right of display 18. From either step 108 or step 110, the program proceeds to step 112 to decide whether the display is operating in zone one in which a goalkeeper is displayed. If it is so operating, the program bypasses step 114 and proceeds directly to step 116 to provide any sounds required. By bypassing step 114, the goal-keeper G remains visible on the screen of display 18. Alternatively, if play is not taking place in zone one at step 112, the goalkeeper G is rendered invisible at step 114 before proceeding to produce any other appropriate sounds at step 116. As explained elsewhere, the game 10 also produces various other sounds to emphasize play. Step 116 accomplishes a branching function to produce a single whistle, a double whistle, a triple whistle, a low tone, a medium tone (beep), a high tone, and a goal song.

After step 116, the program proceeds to decision step 118 to determine whether a time-out in play has taken place such as at half time, when a ball goes out of bounds, and on a kickoff. If play of the game 10 is not at an appropriate point for a timeout, the program proceeds to step 120 to determine whether time has changed since the last time check. If it has changed, the program proceeds to step 122 to produce the necessary timing sound (usually a tick, but a buzz if ball B is loose) which simulates the passage of a second. After producing a timing sound at step 122, the program moves to step 124 in which the defensive player's moves are automatically computed and executed by the game 10. From step 124, the program proceeds to step 126 in which movements of the offense are computed and executed. From step 126, from step 118 if the time out has been taken, and from step 120 if the time has not changed since last checked, the program proceeds to step 128 in which new formations are set up and inbounds turnovers are executed. At step 128, the kickoff formation, the throw-in formation, the corner kick formation, the goal kick formation, the inbounds turnover play, and the collision play may take place depending on the particular stage of the game.

From step 128 the operation of the main program of master controller 58 proceeds to step 130 in which data is relayed to the slave chip 56 and the program returns to step 102 for the random number generation routine, the game 10 circulates through the the main program of the master controller 58 continuously as play progresses.

FIG. 5(*b*) illustrates a flow chart of the main program of the slave controller 56 of the game 10 of this invention. Communication with the master controller 58 takes place at step 131. The program then moves to decision step 135 to determine whether data has been received from the master controller 58. If data has been received, the program moves to step 132 in which certain team changes are initiated, to step 133 to determine whether the offensive player under control of the keys 26–29 needs to be changed and, if so, to execute this change. Thereafter, the program moves to step 134 in which passes are completed. If data has been received, the program moves to step 136 to perform the operation of moving the offensive man $0_1$ or $0_2$ which is controlled by the operator. From step 136 the program moves to step 138 to determine and effect the movement of the ball B. The program then moves to step 140. If data has not been received from the master controller 58 at step 131, the program bypasses steps 132, 133, 134, 136, and 138 and moves directly to step 140.

At step 140 an inquiry is made as to whether the ball B is presently under control of an offensive player or, alternatively, is proceeding through a shot or a pass or is otherwise a loose ball. If the ball B is loose, the program proceeds to step 142 in which the offensive man which has just passed or shot the ball B is rendered invisible so that its blinking will not interfere with the attempt of the operator to catch or retrieve the ball B. If the ball B is, on the other hand, under control of the offensive player $0_1$, the program proceeds from step 140 to step 144 to move the ball to the position of the offensive player $0_1$ which controls the ball. In this manner, the offensive player $0_1$ controlling the ball B and the ball B appear to proceed together on the display 18.

The program then proceeds to step 146 to determine whether the ball B should be lit. If so, the program proceeds to step 148 at which the ball B is turned on and then turned off.

From step 148 and from step 146 if the ball B should not be lit, the program proceeds to step 150 to cause the offensive player $0_1$ handling the ball to be lit. The program then proceeds to step 152 to determine whether the offensive player $0_2$ should blink. If it should, the program proceeds to step 154 to turn on and off the offensive player $0_2$. If the offensive man $0_2$ should not blink, the program proceeds (as it does from step 154) to step 156 to display the defenders D on the display 18 one after another. Following step 156, the program proceeds to step 158 to update the timing and to step 160 to cause the digit 34 to display the team on offense and the digit 36 to display the zone of play, unless the time remaining in the first half of the game runs out whereupon the program branches from step 158 to the "Stop it" portion of step 522 (FIG. 5(*l*)). From step 160, the program proceeds to step 162 to scan the various input switches and perform the particular routines designated by those switches and then returns to step 131 to communicate with the master controller 58.

The sub-routines which implement the various steps of the main operations of the master controller 58 are shown in FIGS. 5(*c*)–5(*j*).

FIG. 5(*c*) illustrates the sub-routine for providing a time signal at step 122 during the play of the game 10 to enable the operator to know whether play is proceeding normally. In the preferred embodiment, a tick is provided to simulate a clock sound as long as play is underway and the ball B is controlled by offensive player $0_1$. If the ball B is loose, a short buzz sounds. Step 122 is entered at step 184 of the sub-routine and proceeds to decision step 186 where the determination is made as to whether it is an appropriate time for a timing signal to be generated. If it is not, the program moves directly to step 124 of the main program of the master controller 58. If it is time for a timing signal to be given at step 186, the program moves to step 188 to determine whether the ball B is presently under control of the offense. If the ball B is under control of the offensive man $0_1$, then the program moves to step 190 where it causes the generation of a tick sound by the speaker 70 shown in FIG. 4 and then returns to step 124 of the main program. If the ball is not presently under control of the offensive player $0_1$, the program moves to step 192 and generates a short buzz to indicate that the ball B is a loose ball. After step 192 the program returns to step 124 of the main program.

The sub-routine for the step 124 of the main program of the master controller 58 is shown in FIG. 5(*d*); this sub-routine in which the defenders D and the goalkeeper G are moved is entered at step 200. The program proceeds directly to decision step 202 where a determination is made as to whether it is time to move any particular defensive man D. It should be noted that in the preferred embodiment there is one move of a defense man per blink in the slow mode and two moves per blink in the fast mode of either game. If it is not time to move a defensive man, the program returns to step 126 of the main program. If it is time to move a defender D, the program proceeds from step 202 to step 204 to determine whether a low kick is in progress. If a low kick is in progress, then the defenders D are held in place, and the program proceeds directly to step 126 of the main program.

If a low kick is not in progress at step 204, the program proceeds to step 206 to generate a random number from zero to seven. This number is used in order to determine which of the defenders D to move. There is a probability of three in eight if play is taking place is zone one that the goalkeeper G will move and a one in eight probability that any other defender D will move. If play is taking place in other than zone one, then the number is used to select the defender D to move with a one in five probability that any particular defender D will move. This is accomplished at decisional step 208 at which it is determined whether the number generated at step 206 is greater than four. If it is greater than four (that is, five, six, or seven), the program moves to step 210 to determine whether play is taking place in zone one. If play is not taking place in zone one so that the goalkeeper G is not involved, the program returns to step 206 to generate a second random number which is used to select the particular defender D to move. If the number is greater than four, the program recirculates through step 210 until a number less than five has been selected.

If play is taking place at step 210 in a zone one and a number greater than four has been selected at step 208, the program moves from step 210 to step 212 to determine whether the ball B is in row two (the center) of the display 18. If the ball B is in row two, then the program moves to step 214 where it attempts to move the goalkeeper G to a trial position in row two. If the ball B is not in row two, the program moves from step 212 to step 216 to determine whether the goalkeeper g is in row two. If the goal-keeper G is not in the center row, the program moves to step 214 to set a trial goalkeeper position at row two in the center of the field. If the goalkeeper G is already in the center row, the program moves to step 218 to determine whether the ball is above the center row. If it is above the center row, the program moves to step 220 to set a trial goalkeeper position in row three above the center row. If the ball is not above the center row, the program moves to step 222 to set the trial goalkeeper position to row one. From steps 214, 220, and 222 the program proceeds to step 224 to determine whether the trial position results in a collision between players. If it does, then the move is not made, and the program moves to step 126 of the main program to move the offense. If the trial position does not result in a collision between players, the program moves to step 226 to move the particular defender (in this case the goalkeeper G) to the trial position selected above. The program thereafter returns to step 126 of the main program to accomplish the move of the offense.

If at step 208 a random number zero through four is ultimately generated, the program moves to step 228 to compute the distance from the particular defender D (chosen by selection of the random number) to the ball B, the distance being calculated by adding the absolute horizontal and absolute vertical distances. From step 228, the program moves to step 230 to inquire whether the distance from the selected defender D to the ball B is equal to or less than one. If the distance between the defender D and the ball B is one or less, then the program moves to step 232 and, with a probability of one out of two, decides whether to intercept or kick away the ball B. If it decides not to intercept or kick away the ball B, the program moves directly to step 126 of the main program to move the offensive players. If at step 232 it is determined to intercept or kick away the ball B, the program moves to step 234 to determine whether the ball is presently held by the offensive man $0_1$. If the ball is not held by the offensive man $0_1$ at step 234, the program moves to step 236 to see if the ball is in a middle move of a high kick. If so, the ball B cannot be intercepted; and the program moves directly to step 126 without intercepting the ball.

If the ball B is not in the middle of a high kick at step 236 or if the ball is held by the offense at step 234, the program moves to step 238 to generate the probabilities for an inbounds turnover. These probabilities are one out of sixteen that the ball will be turned over to the defense at the slow speed of play and one out of eight at the high speed of play in either game. From step 238, the program moves to step 240 at which it is determined whether an inbounds turnover should occur. If it should, then the program moves to step 242 to request an inbounds turnover play from the slave controller 56 and moves therefrom to step 130 of the main program.

If at step 240 it is determined that an inbounds turnover should not take place, the program moves to step 244 to ask whether the game being played is game one. During game one, the ball B is rebounded to the offense if no turnover occurs. Therefore, if game one is being played, the program moves to step 246 to see whether the ball is under control of an offensive player. If it is under control of an offensive player, the program moves directly to step 126 because no rebound can occur at the game one level with the ball B already held by the offense. On the other hand, if the ball is not held at step 246, the program moves to step 248 to request a rebound to the offense from the slave controller 56. The program moves directly from step 244 if game one is not in progress to step 248 to request a kickaway from the slave controller 56. From step 248, the program moves to step 126 of the main program of the master controller 58.

If at step 230 the distance from the ball B to the selected defender D is greater than one space, so that the question is not whether to intercept or kick but how to move the selected defender D, the program moves to step 250 to determine how many defenders D appear in each row. From step 250 the program moves to step 252 to determine whether the selected defender D is the only defender D in its row. If it is not, the program moves to step 254 to find the nearest row without a defender D and to step 256 to attempt to move the selected defender D to the nearest row in which there is no defender. The program then proceeds from step 256 to step 224 and proceeds thereafter as explained above.

If the chosen defender D is the only defender D in its row, then the program moves to step 258 to generate a probability number for attempting to move the defender D toward the ball B. As outlined in the chart above, this probability is equal to one over the distance between the ball B and the defender D minus one. The program moves from step 258 to decision step 260 in which it is determined whether the probability number generated is such that the defender D should attempt the move. If not, the program returns to step 126 of the main program. If the defender D should attempt to move, the program moves to step 262 to determine the vector between the defender D and the ball B. If the vector is diagonal, the program randomly selects either the horizontal or vertical component as an appropriate move and attempts a trial move in the selected direction. Thereafter, the program proceeds to step 224 to determine whether the trial position results in a collision and to move or refrain from moving the defender D based thereon. The program hereafter moves to step 126 of the main program to move the offense.

FIG. 5(*e*) is a flow chart for the sub-routine of step 126 of the main program of master controller 58 by which the offensive player $0_2$ is automatically moved. Step 126 is entered at step 270 of the sub-routine and moves directly to decision step 272 at which it is determined whether or not it is time for the offense to move. It it is not time for the offense to move, the program cycles to step 128 of the main program. If it is time for the offense to move, the program moves to decision step 274 to determine whether an automatic move of offensive player $0_2$ should be made. Such a move will be made in all modes of the game except during passes or shots, one of the special formations such as a throw-in, a corner kick, a goal kick, or a kickoff when control of offensive man $O_2$ is transferred to the keys 26–29, or if the teammate key 22 has once been used. If the offensive man $0_2$ is not to be moved automatically, the program moves to step 128 of the main program. If the offensive man is to be moved automatically, the program proceeds to step 276 to determine whether the ball B is presently under control of the offensive man $0_1$. If the ball is not under control of the offensive man $0_1$ such as during a pass or a shot, the program moves to step 128 of the main program. If the ball is presently under control of the offensive man $0_1$, the program moves to step 278 to determine in which row the offensive man $0_1$ is positioned.

As explained above, the offensive man $0_2$ attempts to move to receive a pass at a diagonal ahead of the offensive man $0_1$. Thus, if the offensive man $0_1$ is in row zero or one, the offensive man $0_2$ moves toward the target row four. If the offensive man $0_1$ is in row three or four, the offensive man $0_2$ moves toward target row zero. If the offensive man $0_1$ is in row two, the offensive man $0_2$ moves toward target row zero when play is in odd numbered zones and target row four when play is in even numbered zones. Consequently, the determination at step 278 moves the program to step 280 if the offensive man $0_1$ is in row zero or one, to step 282 if the offensive man $0_1$ is in row three or four, and to step 284 if the offensive man $0_1$ is in row two. If the program moves to step 280, the offensive man $0_2$ is directed toward row number four. If the program moves to step 282, the offensive man $0_2$ is directed toward target row zero. If the program moves to step 284, it then moves to step 280 or 282 depending on whether the zone of play is even or odd numbered and proceeds as explained.

From steps 280 and 282, the program moves to step 286 to determine toward which column the offensive man $0_2$ should move. If the offensive man $0_1$ is in row zero, or four, then the diagonal to which offensive man $0_2$ should be moved is four columns ahead of the offensive man $0_1$. If the offensive man $0_1$ is in row one or three, the diagonal is three columns ahead; and in row two, two columns ahead.

Having determined the row toward which and the number of columns through which the offensive man $0_2$ should be moved, the program proceeds to step 288 to determine which team is presently on offense. If the visitors' team is on offense, the program moves to step 290 and adds the column factor (how many columns ahead of the offensive man $0_1$) to the column position of the offensive man $0_1$. This occurs because the visitors' team moves from left to right on display 18. If the home team is on offense, the program moves to step 292 to subtract the column factor from the column position of the offensive man $0_1$ and then proceeds to step 294 to determine whether the result of the subtraction is a negative number. If the column number is negative, the program moves to step 296 to make column zero the target column so that the offensive man $0_2$ cannot proceed out of the particular zone in which play is taking place.

From steps 290, 296, and 294 (presuming a negative column number was not obtained), the program proceeds to step 298 to determine whether the result of addition of the column factor to the column of offensive player $0_1$ when the visitors' team is on offense is greater than six. If it is greater than six, then the target column becomes column six at step 300, again so that the player $0_2$ cannot leave the zone of play. If the target column is six or less, the program moves to step 302 and uses the selected target column.

From steps 300 and 302, the program proceeds to step 304 to determine the vector from the present position of the offensive man $0_2$ to the target position of the offensive man $0_2$ and, if that vector is diagonal, to randomly select a vertical or horizontal move. The program next moves to step 306 to initiate a trial move of offensive player $0_2$ in the selected direction. From step 306, the program proceeds to decision step 308 to determine whether the trial position is occupied by a defender D. If the trial position is not so occupied, the program proceeds to step 310 where the offensive player $0_2$ is moved to the trial position; and the program proceeds to step 128 of the main program.

It will be recalled that if the initial move selected for the player $0_2$ cannot be completed, the control circuitry selects an alternate move on the following basis: if the attempted move was left, the alternates are selected in the order down left, up left, down, and up; if the attempted move was right, the alternate moves are in order down right, up right, down, and up; if the attempted move was down or up, no alternate moves are selected; and if no alternate move can be made, the player $0_2$ does not move on that cycle.

Consequently, if the trial position is occupied by a defender D, the program moves to step 312 where a determination is made as to whether the original vector was purely vertical (up or down). If it was purely vertical, the program moves to step 128 of the main program and skips this move for the offensive man $0_2$.

If the original vector was not purely vertical, the program moves to step 314 to determine whether the selected vector pointed down. If the selected move points neither down nor purely up (as determined at step 318), it must be to the left, right, up left, or up right; and the program moves to step 320 to determine whether there is an up component. If there is not an up component (the attempted move was left or right), a down component is added to the attempted move at step 322; and the program recycles to step 306 to attempt this new move which is down left or down right. If this move is possible, the program moves through steps 308 and 310 and returns to step 128 of the main program.

If the new move of down left or down right is impossible at step 308, the program moves to step 312 where it is determined that the attempted move is not purely vertical and to step 314 where it is determined that the vector points down. The program then moves to step 316 where the down component of the vector is replaced with an up vector giving a new move which is either up left or up right. The program then recycles to step 306 to attempt this move, to step 308 to determine whether the position is occupied, and if not, to step 310 to complete the move and return to step 128.

If the new up left or up right move is impossible at step 308, the program moves through steps 312, 314, and 318 (explained above) to step 320 at which it is determined that an up component exists in the attempted move. This causes the program to move to step 324 to replace the entire move with a purely down vector. The program then recycles to step 306 to try this move and exit if successful. If not successful, the program moves through steps 308, 312, and 314 and at step 316 replaces the down vector with a purely up vector. The program then recycles to step 306 to test this move. If the move is successful, the program exits via steps 308 and 310. If the move is unsuccessful, the program exits the subroutine via steps 308, 312, 314, and 318 and returns to step 128 of the main program. In this way, the program selects alternative moves for the offensive man $0_2$, as explained above, when a first trial move is not possible.

FIG. 5(*f*) is a flow chart for the sub-routine of step 128 of the main program of master controller 58. The flow chart is entered at step 330 and proceeds to step 332 in which the program selects a particular sub-routine to which it should branch based on requests generated by the slave controller 56. In step 332, the zero branch is taken when no particular formation need be set up, an inbounds turnover is not required, and a collision has not occurred. In such case, the program moves automatically to step 130 of the main program. If branch one of step 332 is taken, the program moves to step 334 to set up the kickoff formation. If branch two of step 332 is taken, the program moves to step 336 to set up the throw-in formation. If branch three of step 332 is taken, the program moves to step 338 to set up the corner kick formation. If branch four is taken, the program moves to step 340 to set up the goal kick formation. If branch five is taken, the program sets up an inbounds turnover; and if branch six is taken, the program reacts to a collision.

As explained above, in an inbounds turnover, the defender D moves to the position occupied by the ball B to become the new offensive player $0_1$, and the positions of all players and the ball B are mirrored about the center column (column three) of the zone. To accomplish this, the program moves on branch five to step 342 at which the new offensive player $0_1$ is established at the position of the ball B. The program then proceeds to step 344 to mirror all of the players and the ball B about column three of the display 18 thereby to set up a formation identical to that faced by the original offensive man $0_1$ with the original defensive team now being on offense. Thereafter, the program moves to step 130 of the main program.

Branch six of step 332 occurs when a collision between a defensive man D or the goalkeeper G and the ball B takes place. When branch six is selected, the program moves to step 238 shown in FIG. 5(*d*) and proceeds therefrom as explained above. The program then returns to step 130 of the main program.

A kickoff is set up as is shown in FIG. 5(*g*). The program proceeds from step 334 to step 360 to set up a standard kickoff formation such as is shown in FIG. 3(*a*). The program then moves to step 362 to determine whether the home team has the ball B. If the home team does not have the ball, then the program moves directly to step 130 of the main program shown in FIG. 5(*a*). If the home team does have the ball, then the configuration for a kickoff which was set up at step 360 for the visitors' team on offense must be directed in the opposite direction. Consequently, the program moves to step 364 where the kickoff configuration is mirrored about column three on display 18. The program then moves to step 130 of the main program of the master controller 58.

If the program branches to the out-of-bounds throw-in step 336 of FIG. 5(*h*), the program moves to step 370 to determine whether the ball B went out of bounds on the upper boundary. The ROM of the master controller 58 is provided with a single setup for the throw-in play, arranged in the lower middle of display 18 as shown in FIG. 3(*d*). In order to obtain the various other formations for out-of-bounds at other field positions, it is necessary to reverse the field about column three or row two. Consequently, if the ball went out of the upper boundary, the program moves to step 372 to store a command to reverse the position of the players on the field in the standard configuration about row two. Thereafter, the program moves from either step 372 or step 370 to step 374 to determine whether the ball went out-of-bounds in columns four, five, or six. If the ball went out-of-bounds in column four, five, or six (that is, the right end of the field of display 18), then the position of the players on the field in the standard configuration must be reversed about column three and this information is stored at step 376. From step 376 or from step 374 if the ball went out other than at columns four, five, or six, the program moves to step 378 to determine the distance from the ball B to column three and stores that distance so that the standard configuration may be varied with the distance with which the ball went out from the center of the field. The program then moves to step 380 to set up the standard throw-in configuration and to step 382 to offset and correct the standard formation according to the distance from column three at which the ball B went out of bounds. As explained above, none of the defenders D can be immediately adjacent the offensive man $0_1$ having the ball, so as the formation moves closer to a corner, it is necessary to move the defenders D to slightly different positions. (See FIG. 3(*d*)).

The program then moves to step 384 and if the display is to be mirrored on column three as determined at step 376, the program moves to step 386 to accomplish this mirroring of the configuration about column three. The program then moves from step 386 or from step 384 if reversal about column three is not required to step 388 to determine whether reversal about row two is required. If no reversal is required, the program moves to step 130; if reversal is required, the program moves to step 390 to reverse the field about row two and then proceeds to step 130 of the main program of the master controller 58.

If the play requires a corner kick formation to be set up, the program moves to step 338 shown in FIG. 5(*i*) and from there to step 400 to determine whether the ball B went out of bounds on the upper half of the field of display 18. As with the inbounds play above described, a single master setup is stored in the ROM of the master controller 58 for corner kicks; and this setup must be mirrored about row two and column three of the display 18 to obtain four distinct formations. If the ball B went out in the lower half of the field, the program proceeds to step 402 to store this information. From step 402 and from step 400 if the ball went out in the upper half of the field so that no reversal of the standard configuration is required, the program proceeds to step 404 to set up the standard corner kick configuration. The program then moves to decision step 406 to see if a reversal was stored at step 402. If so, the program moves to step 408 to mirror the standard configuration for a corner kick about row two. From step 408 and from step 406 if no reversal flag was set at step 402, the program moves to step 410 to determine which team is on offense. As the standard configuration for a corner kick has the visitors' team on offense, if the visitors' team is on offense, the configuration need not be changed; and the program moves to step 130 of the main program. If the home team, however, is on offense at the corner kick, the program moves to step 412 to mirror the standard corner kick configuration about column three. The program then moves to step 130 of the main program of the master controller 58.

FIG. 5(*j*) describes the flow chart for a goal kick which begins at step 340. The program proceeds from step 340 to step 420 to determine whether the ball went out of bounds to the right. Once again, a standard play configuration is set up with the visitors' team being on offense; if the ball went out-of-bounds at the left, then a reversal must take place about column three, and the program moves to step 422 to store this information. From step 422 and from step 420 if the ball went out-of-bounds to the right, the program proceeds to step 424 to set up the standard goal kick configuration. From step 424 the program moves to step 426 where it is determined whether a field reversal is required. If it is not, the program moves directly to step 130 of the main program. If a reversal has been stored at step 422, the program moves to step 428 to accomplish that reversal and then to step 130 of the main program of the master controller 58.

FIGS. 5(*k*)–5(*t*) show sub-routines for various steps of the program of the slave controller 56. FIG. 5(*k*) illustrates the sub-routine of the bump step 132 shown in FIG. 5(*b*). Step 132 is used during collisions and is entered at step 490 on FIG. 5(*k*) and proceeds directly to step 492 where a determination is made to whether an inbounds turnover request was received from the master controller 58. If such a request was received, the program moves to step 494 which accomplishes all steps for the change of team on offense. The program then moves to step 496 to request an inbounds turnover formation from the master controller 58 and back to step 133 of the main program shown in FIG. 5(*b*).

If the inbounds turnover has not been requested at step 492 of FIG. 5(*k*), the program moves to step 498 to determine whether a rebound or kickaway is to be set up. If neither play is to occur, the program returns to step 133 of the program shown in FIG. 5(*b*).

If a rebound or a kickway by the defense is to occur, the program moves to decision step 500 to determine whether game one is being played. If game one is being played, the program moves to step 502 to request an exchange of control between the offensive players $0_1$ and $0_2$ since (with no turnover) the ball is rebounded by the defense to the offensive player $0_1$ that shot or passed the ball which became a loose ball. The program then moves to step 504 to place the ball with the original player $0_1$ and returns to step 133 of the routine shown in FIG. 5(*b*).

If at step 500, it is determined that game two is being played, the program moves to step 506 to set up a kickway of one square by the defensive player D or goalkeeper G which intercepted the ball B. The program then moves to step 508 to request a low tone from the master controller 58 and moves to a decision step 510. At step 510, a determination is made as to whether the home team or the visitors' team is on offense. If the home team is on offense, the program moves to step 512 which accomplishes a shot to the right while if the visitors' team is on offense the program moves to step 514 which accomplishes a shot to the left. This step is necessary because the visitors' defense will kick in one direction while the home team defense will kick in the other direction.

The sub-routine for step 494 shown in FIG. 5(*k*) is illustrated in FIG. 5(*l*). The routine is entered at step 519 and moves directly to step 520 at which a request for a change of teams on offense and defense is accomplished. The program then moves to step 522 to clear any existing player move request, to step 524 to request a whistle sound from the master controller 58, and to step 526 to stop the running of play. The program then moves to step 528 to store the information in memory that a formation must be started, to step 530 to store the information in memory that a reset is required, to step 532 to indicate that no moves remain in the kick, and to step 534 to indicate that the program is ready for requests. From step 534 the program moves to step 496 of the sub-routine shown in FIG. 5(*k*).

FIG. 5(*m*) illustrates a flow chart for the sub-routine of step 134 shown in FIG. 5(*b*) which is used in completing a pass or a shot to update the display 18. Step 134 is entered at step 540 and moves to step 542 at which it is determined whether the ball B is in the air on a high kick or is held by the offensive player $0_1$. If the ball is in the air or it is held by the offensive player $0_1$, the program moves to step 135 of the main program of the slave controller 56. If the ball is not in the air or held by the offensive player $0_1$, the program moves to step 544 to determine whether any moves remain on a shot or pass. If moves do remain, the program moves to step 546 to determine whether the defense last touched the ball. If it did, the program then returns to step 135 of the main program of the slave controller 56. If the defense did not last touch the ball or if there are no moves remaining on a kick at step 544, the program moves to step 548 to determine whether the ball B and the offensive player $0_1$ are on the same space. If they are not, the program returns to step 135 of the main program of the slave controller 56. If the ball B and player $0_1$ are in the same place, the program moves to step 550 to make offensive player $0_2$ visible, to step 522 to cause the ball B to be held by offensive player $0_1$, and to step 554 to store the information that the ball B was last touched by the offense. The program then returns to step 135 of the main program of the slave controller 56.

FIG. 5(*n*) is a flow chart for step 136 of the main program of the slave controller 56. This sub-routine is used for moving an offensive player $0_1$ under control of the keys 26–29. The sub-routine is entered at step 560 and proceeds directly to step 562 to see if a move has been requested by depression of the keys 26–29. If none has been requested, the program moves to step 138 of the main program. If a move has been requested, the program moves to step 564 to clear the outstanding move request and to step 566 to determine whether the offensive player $0_1$ is the player to be moved. If offensive player $0_1$ is the player to be moved, the program moves to step 568 to attempt a trial move of offensive player $0_1$. If offensive player $0_1$ is not to be moved at step 566, the program moves to step 570 to attempt a trial move of the offensive player $0_2$. From each of steps 568 and 570, the program moves to step 572 to determine whether the trial move is in bounds. If the move is not in bounds, the program moves to step 574 to determine whether it is out of bounds at the upper or the lower boundary. If it is out of bounds at either the upper or lower boundary, the program returns to step 138 of the main program since such a move is not allowed. If the move is not out of bounds at the upper or lower boundaries, the program moves to step 576 to determine whether it is the offensive player $0_1$ who controls the ball and is attempting to go out of bounds to the left or right. Since the offensive player $0_2$ cannot go out of bounds to the left or right, if offensive player $0_2$ is so attempting, the program returns to step 138 of the main program. If the player $0_1$ is attempting to go out of bounds to the left or right, the program moves to step 578 to determine whether the player $0_1$ holds the ball B. It it does not hold the ball B, the program returns to step 138 since the player $0_1$ cannot traverse the end lines without the ball B. If it does hold the ball B, the program moves to step 580 to initiate a zone change so that the zone number is incremented or decremented on digit 36 of display 18 and, if necessary, to request a goal kick or a corner kick. The program then moves to step 582 to determine whether the new zone is zone zero or ten. If it is, the program returns to step 138 since these are the end lines. If the new zone is not zone zero or ten, the program moves to step 584.

The program also moves to step 584 if it is determined at step 572 that the trial move of the player $0_1$ or $0_2$ is in bounds. Step 584 determines whether the trial move would cause a collision with a defender D or the goalkeeper G. If it would, the program returns to step 138 of the main program since this move cannot take place. If a collision with a defender D or the goalkeeper G does not occur on the trial move, the program moves to step 586 to move the particular offensive player to the trial position. The program then moves to step 588 to determine whether the move of the player was into offensive zone one. If it was, the program moves to step 590 to request a sound from the master controller 58 to indicate that the play is taking place in zone one. From step 590 and from step 588 if the move did not cross into zone one, the program moves to step 138 of the main program of the slave controller 56.

FIG.5(*o*) illustrates the flow chart for the sub-routine of step 138 of the main program of the controller 56. The sub-routine is entered at step 600 and moves directly to step 602 where it is determined whether the ball B is presently held by offensive man $0_1$. If it is so held, the program returns to step 140 of the main program. If it is not held by the offensive man $0_1$, the program moves to step 604 to determine whether it is time to move the ball B. If it is not time, the program returns to step 140 of the main program. If it is time to move the ball B, the program moves to step 612 to update the high/low status and to step 614 to decrement the moves to go in the particular shot or pass. The program then moves to step 616 to determine whether there are negative moves to go, and if so, returns to step 140 of the main program.

If there are not negative moves to go, the program moves to step 618 to attempt a trial move of the ball B. From step 618, the program moves to step 620 to determine whether the trial move position for the ball B is in bounds. If the ball B would be out of bounds at the trial move position, the program moves to step 622 to determine whether the ball B would go out-of-bounds at the upper or lower boundaries. If the ball B would be out-of-bounds at the upper or lower boundaries, the program moves to step 624 to determine whether the ball is in the air. If the ball is in the air, it must stop at an upper or lower boundary; and the program moves to step 626 to stop the movement of the ball and return the program to step 140 of the main program. If the ball is not in the air at step 624, the program moves to step 628 to change the teams if necessary and to step 630 to request a throw-in. The program then returns to step 140 of the main program.

The change sides sub-routine of step 628 is shown in FIG. 5(*l*). This routine is entered at step 632 and proceeds directly to step 634 to determine whether the defense last touched the ball B. If the defense did not touch the ball last, then a change of sides is necessary and the program moves to step 520 and through the remaining steps of FIG. 5(*l*), explained above, required for accomplishing a change of sides. If the defense last touched the ball, then the program moves directly to step 522 to accomplish those steps which accompany a throw-in play without requesting a change of sides.

If at step 622 of FIG. 5(*o*) the trial position of the ball B was out of bounds at either the left or the right boundaries, the program moves to step 580 where zone numbers are changed and where it is determined whether the ball B has gone over a goal line requiring a goal kick, a corner kick, or a kickoff; and such routines are requested. The program then moves to step 638 to determine whether play is now in zones zero or ten (beyond the goal line) and, if so, returns to step 140 of the main program of the slave controller 56.

If the play is not in zone zero or ten, the program moves to step 640 to determine whether the ball B is in the air. The program also moves to step 640 from step 620 if the trial position of the ball B is found to be in bounds. If the ball B is in the air at step 640, collision with a defender D is not possible so the program moves to step 642 to move the ball to the trial position and then returns to step 140 of the main program. If the ball B is not in the air, the program moves to step 644 to determine whether collision with a defender D or goalkeeper G will take place at the trial position. If no collision will take place, the program moves to step 642 to move the ball B to the trial position and returns to step 140 of the main program. If a collision with a defender would take place at step 644, the program moves to step 646 to determine which team last touched the ball B. If the defense last touched the ball B, the program moves to step 648 to move the ball B to the trial position and then moves to step 650 to send a collision play request to the master controller 58. If the offense last touched the ball at step 646, the program moves directly to step 650 to send a collision play request to the master controller 58. From step 650 the program returns to step 140 of the main program of the slave controller 56.

The sub-routine of step 580 shown in FIG. 5(*o*) for changing zone numbers and for determining the need for and effecting corner kicks, goal kicks, and kickoffs is shown in FIG. 5(*p*). The sub-routine is entered at step 660 and proceeds directly to step 662 where it is determined whether the ball B went out of bounds at the offensive goal or not. If the ball B went out of bounds over the offensive goal, the program moves to step 664 to indicate that the next zone of play is the current zone minus one. If the ball B did not go out of bounds over the offensive goal but went out of bounds over the defensive goal, the program moves to step 666 to indicate that the next zone is equal to the current zone plus one. From either step 664 or step 666, the program proceeds to step 668 to ask whether the zone in which the ball B is positioned is the zero zone. If it is not the zero zone (the ball B did not go beyond the goal line), the program moves to step 670 to determine whether the potential zone is ten (the ball B moved beyond the defensive goal line). If the zone is not ten, the program returns to step 638 shown in FIG. 5(*o*) or to step 582 shown in FIG. 5(*n*) depending on where the program started.

If the ball B has moved into zone ten, a corner kick, goal kick, or kickoff is necessary so the program moves to step 672 to determine whether the ball B was last touched by the defense. If not, the program moves to the change sides routine 628 shown in detail in FIG. 5(*l*). The program then moves to step 674 to request a corner kick and returns to step 638 of FIG. 5(*o*) or to step 582 shown in FIG. 5(*n*) depending on where the program started. If the ball B was last touched by the defense at step 672, the program moves to step 676 to ask whether the ball B went over the goal line on the center row. If the ball B went over the goal line on the center row, a goal has been scored, while if the ball B went over the goal line on another row, a goal kick is necessary.

If a goal was scored, the program moves from step 676 to step 628 to determine whether to change the offense between visitors and home and to stop play. The program then moves to step 678 to request a kickoff and to request the score be incremented. The program moves from step 678 to step 680 to request a goal sound and returns to step 638 shown in FIG. 5(*o*).

If the ball B went out of bounds at step 676 other than on the center row, the program moves to step 628 to determine if there is a need to change the side on offense and to stop play and then to step 682 to request a goal kick formation. The program then moves from step 682 to step 638 of the routine shown in FIG. 5(*o*).

If at step 668 the ball B has gone over the goal into the zero zone, the program moves to step 684 to determine whether the ball B crossed on the center row so that a goal might have been scored. If not, the program moves to step 628 to change the side on offense, to step 682 to request a goal kick, and returns either to step 638 or step 582. If the ball B is on the center row at step 684, the program moves to step 686 to determine whether the ball B is in the air or not. If the ball B is in the air, a goal cannot be scored for the ball B goes over the goal cage; and the program moves to step 628 to change the side on offense and to step 682 to request a goal kick formation. The program then returns to step 638 shown in FIG. 5(*o*).

If the ball B is not in the air at step 686 in crossing the goal line, the program moves to step 688 to determine whether the ball B is held by offensive player $0_1$ in crossing the goal line. A ball B held by an offensive player cannot score a goal and causes the program to return to step 582 shown in FIG. 5(*n*). If the ball B is not held in crossing the goal line on the ground in the center row, a goal is scored; and the program moves from step 688 to step 628 to exchange the offense and defense, to step 678 to request a kickoff formation and an increment in the score, and to step 680 to request a goal sound. The program then returns to step 638 of the sub-routine shown in FIG. 5(*o*).

The timing step 158 of the main program of the slave controller 56 accomplishes the various functions necessary within the controller 56 to time the flashing on and off of the ball B and of the offensive man $0_2$, to produce the tick sound which simulates the passage of time during the play, to produce the timing for ending the first half of the game, and to initiate the sound signals which accompany the end of the first half and the end of play of the game 10.

The flow chart for the switch input sub-routine of step 162 of the main program of the slave controller 56 is shown in FIG. 5(*q*). The sub-routine is entered at step 690 and moves directly to step 692 to scan the input keys 20–29 for closures and store the results of the scan. The program then moves to step 693 where the speed of play is set at slow. The program then moves to step 694 to determine whether the mode of play is to be at fast speed. If the program is to take place at fast speed, the program moves to step 696 to implement this fast speed. If play is to take place at the slower speed, the program bypasses step 696 and moves directly to step 698 to see if any previously closed switch has been released. If a previously closed switch is still being pressed or has just been released on this cycle of the program, the program moves to step 131 of the main program of the slave controller 56.

If any previously closed switch was released prior to the current cycle of the program, the program moves to step 706 to determine whether reset is needed such as before the start of any standard formation. If a reset is needed, the program moves to step 708 to disable all but the reset (score) key 22 and then to step 710. If reset is not needed at step 706, the program moves directly to step 710 where it is determined whether a standard formation is set up. If such a formation is set up, the program moves to step 712 to determine if offensive player $0_1$ is selected to move. The offensive player $0_2$ may be selected to move at any time in game two by depressing the teammate key 21 to transfer control. If control is over offensive player $0_1$, the program moves to step 714 to clear all move indications for offensive player $0_1$.

From step 710 if a standard formation is not set up, from step 712 if offensive player $0_1$ is not selected to move, and from step 714, the program proceeds to step 716 to determine if game one is being played. If game one is being played, the program moves to step 718 to clear the high/low key 23 and the teammate key 21 because these keys cannot be used in game one. The program then moves to step 720 to determine whether the game is being played in zone one. If it is not being played in zone one, the program moves to step 722 to disable the shoot key 25 because shooting can only take place in a goal zone one when game one is being played. If play is in zone one at step 720 and from step 722, the program proceeds to step 724.

At step 724 the program inquires as to whether any of the keys 26–29 have been depressed and not already cleared (at step 714). If one of these keys has been depressed, the program moves to step 726 to store the particular direction indication and then to step 728 to store an indication that a switch was closed on this cycle. It should be noted that in the preferred embodiment two adjoining ones of keys 26–29 may be depressed coincidentally to cause the controlled player to move on a diagonal.

If no key 26–29 is depressed at step 724, the program moves to step 730 to determine whether the pass or shoot keys 24 and 25 have been depressed. If keys 24 or 25 have been depressed, the program moves to step 732 at which a pass or shot may be executed. If neither the pass nor shoot keys 24 and 25 are depressed at step 730, the program moves to step 734 to determine whether the high/low key 23 is depressed. If this key is depressed, the program moves to step 736 to determine whether the mode is presently low. If the mode is presently low, the program moves to step 738 to set the mode to high and to step 740 to request a high tone. If the mode is currently high at step 736, the program moves to step 742 to set the mode to low and to step 744 to request a low tone. From step 740 and step 744, the program proceeds to step 728 to store an indication that a switch was closed on the present cycle and returns to step 131 of the main program.

If at step 730 either the pass or shoot keys 24 or 25 are depressed, the program moves to step 732 shown in detail in FIG. 5(*r*). From step 732 in FIG. 5(*r*), the program moves directly to step 748 to determine whether the ball B is presently held by an offensive player. If not, the program returns to step 131 of the main program of slave controller 56. If the ball B is held by an offensive player, the program inquires at step 750 as to whether direction keys 26–29 are currently controlling offensive player $0_1$. If the direction keys 26–29 are not controlling offensive player $0_1$, the program returns to step 131 of the main program of the slave controller 56. If the direction keys 26–29 control offensive player $0_1$, the program moves to step 752 to request the exchange in control between offensive player $0_1$ and $0_2$ which takes place on each pass or shot. The program then moves to step 754 to store a length of seven in memory for the pass or shot and to step 756 to store the information that the ball B is separated from the offensive player $0_1$. From step 756 the program proceeds to step 758 to store the information that the offense last touched the ball and to step 760 to determine whether the action indicated is a low kick or not. If the action is not a low kick, the program moves to step 762 to request a high tone from the master controller 58 and proceeds to step 764. If the action indicated is a low kick at step 760, the program proceeds to step 764 to determine whether game one is being played. If game one is not being played, the program moves to step 766 to set a random length kick. The program then moves to step 768 from step 766 (and from step 764 if game one is being played) to request a low tone from the master controller 58.

From step 768 the program proceeds to step 764 to determine whether the action indicated is a pass. If a pass is indicated, the program moves to step 770 to determine the vector to the target position of offensive player $0_2$ and then returns to step 131 of the main program of the controller 56. If a pass is not indicated at step 764, the program moves to step 772 to determine whether game one is being played. If game one is being played, the program moves to step 774 to indicate that row two is the target (i.e., a shot is in progress). If game one is not being played, the program moves to step 776 to set a random length for the shot and then moves to step 774.

From step 774 the program proceeds to step 778 to determine whether the home team is on offense. If the home team is on offense, it shoots toward the left; and the program moves to step 780 to accomplish this. From step 780 the program returns to step 131 of the main program of the slave controller 56. If at step 778 it is determined that the visitors are on offense, the program moves to step 782 to cause a shot to the right to take place and then returns to step 131 of the main program of the slave controller 56.

It should be noted in FIG. 5(*r*) that steps 512 and 514 shown in FIG. 5(*k*) enter the sub-routine of FIG. 5(*r*), proceed through steps 780 and 782, respectively, and then return to step 133 of the main program of the slave controller 56.

If in the sub-routine of FIG. 5(*q*), for determining the meaning of the input switches 20–29, the high/low key 23 has not been depressed at step 734, the program proceeds to step 746 and continues as is shown in FIG. 5(*s*). Step 746 determines whether the teammate key 21 has been depressed. If the teammate key 21 has been depressed, the program moves to step 790 to change keyboard control from offensive player $0_1$ to offensive player $0_2$, to step 792 to halt the automatic movement of offensive player $0_2$, and to step 794 to request a beep tone from the master controller 58. The program then moves to step 728 shown in FIG. 5(*q*) and returns to step 131 of the main program of the slave controller 56.

If at step 746 in FIG. 5(*s*) the teammate key 21 has not been depressed, the program moves to step 796 to determine whether the score key 22 has been depressed. It will be recalled that the score key 22 is used to reset the game at various times during play including when a new formation is set up. If the score key 22 has not been depressed, the program returns to step 131 of the main program of slave controller 56. If the score key 22 has been depressed, the program moves to step 798 to cause player $0_2$ to move automatically and to step 800 to cause the player $0_1$ to be the player under control of keys 26–29. The program then moves to step 802 to determine whether the timer set at step 158 of the main program is running. If the timer is running, the program moves to step 728 shown in FIG. 5(*q*) and returns to step 131 of the main program of the slave controller 56.

If the timer is not running, the program moves to step 804 to determine whether the end of the game has occurred. If the end of the game has not occurred, the program moves to step 806 to store an indication that reset is not needed and to step 808 to determine if a change of sides has been requested. The program also moves to step 808 from step 804 if the end of the game has occurred. If at step 808 no change of sides has been requested, the program then moves to step 810. If at step 808 a change of sides is requested by the control circuitry, the program moves to step 812 to change the offensive team from home to visitor or from visitor to home and to step 814 to change the number of the zone in which play is taking place. This latter step is necessary because in most instances (other than zone five) a visitors' zone will have a different number than a home team zone.

From step 814 the program moves to step 810 where it is determined whether the score needs to be changed. If the score needs to be changed, the program moves to step 816 to increment by one the score of the team previously on offense. From step 810 if no scoring is necessary, and from step 816, the program moves to step 818 where the master controller 58 is requested to set up a formation.

From step 818 the program moves to step 820 to determine whether a kickoff formation has been requested. If such a formation has been requested, the program moves to step 822 to cause the zone indicator 36 to display a five and to step 824 to display the visitor's score. If a kickoff is not requested, the program moves directly from step 820 to step 824. From step 824 the program moves to step 826 to display the home team's score. Thereafter, the program moves to step 828 to display the time remaining in the period. From step 828, the program moves to step 830 to indicate that the low mode has been selected and to step 832 to request a low tone from the master controller 58. From step 832 the program moves to step 728 shown in FIG. 5(*q*) and returns to the main program of the slave controller 56.

FIG. 5(*t*) is a flow chart for the sub-routine of slave controller 56 which occurs when power is initially applied. The sub-routine is entered at step 840 and moves directly to step 842 to initialize the timing and other sequences of the controller 56. The program then moves to step 844 to determine whether the score key 22 has been depressed. If the score key 22 has been depressed, the program moves to step 846 to cause game two to be played and then moves to step 848 to begin the timing sequence of a simulated forty-five minutes. The program also moves to the timing step 848 from step 844 if the score key 22 has not been depressed at step 844. From step 848 the program moves to step 850 to request a kickoff formation from master controller 58 and then moves to step 818 shown in FIG. 5(*s*).

As will be understood by those skilled in the art, many different programs may be utilized to implement the flow chart disclosed in FIGS. 5(*a*) through 5(*t*). Obviously, these programs will vary from one another in various degrees. However, it is well within the skill of the art of the computer programmer to provide particular programs for implementing each of the steps of the flow charts disclosed herein. It is also to be understood that various microcomputer circuits might be programmed for implementing each of the steps of the flow chart disclosed herein without departing from the teaching of the invention. It is therefore to be understood that, because various other embodiments may be devised by those skilled in the art without departing from the spirit and scope of the invention, it is the intention of the inventors to be limited only by the scope of the claims appended hereto.

What is claimed is:

1. An electronic game comprising:

means for simulating a playing field having indications arranged in a matrix of rows and columns representing offensive and defensive players and a ball;

means for initiating a pass of the ball by a first offensive player along a path beginning at a first indication and designated to end at a second indication if the ball is not intercepted or received;

means for designating the pass as a low pass or a high pass;

means for causing a defensive player to intercept the ball in a pass designated as a low pass if the defensive player and the ball are coincident at any indication along the path of the pass;

means for causing a defensive player to intercept the ball in a pass designated as a high pass only if the defensive player and the ball are coincident at the first indication or at the last indication, whereby the ball is capable of being intercepted only when it first leaves the possession of the first offensive player or only when it reaches the end of travel of the pass;

means for causing a second offensive player to receive the ball in a pass designated as a low pass if the second offensive player and the ball are coincident at any indication along the path of the pass; and means for causing a second offensive player to receive the ball in a pass designated as a high pass only if the second offensive player and the ball are coincident at the first indication or at the last indication, whereby the ball is capable of being received only when it first leaves possession of the first offensive player or only when it reaches the end of travel of the pass.

2. The electronic game of claim 1 in which the means for simulating a playing field includes indications representing goals, and which further include;

means for generating input signals including a first manually operable control element for reversibly selecting between the first and the second offensive player to be independently controlled by an operator at any time during the play of the game, and where both the first and second offensive players may move with the ball, pass the ball, and score a goal for the offensive team, and a second manually operable control element for selecting the direction of movement on the display of the indication representing the offensive player selected for operator control;

and control circuit means operated in response to the input signals for controlling the positions of the indication of the offensive player selected for operator control and the ball, and for automatically moving the other players in response to the movement of the operator controlled offensive player and the ball, including means for establishing intervals of play time, means for selecting at a particular interval of time a particular defender for movement, means for determining at the particular interval of time whether the indication of the ball is immediately adjacent the indication of the particular defender, means for determining if any one row of indications does not contain a defender, first movement means for moving at the particular interval of time the particular defender to the indication of the ball to intercept the ball, second movement means for moving at the particular interval of time the particular defender toward a particular row of indications, third movement means for moving at the particular interval of time the particular defender toward the indication of the ball, and movement selection means for selecting at the particular interval of time the first movement means to move the particular defender if the indication of the ball is immediately adjacent the indication of the particular defender, to select the second movement means to move the particular defender if the indication of the ball is not immediately adjacent the indication of the particular defender and if the particular row does not contain a defender to effectively close an open row to one goal, and to select the third movement means to move the particular defender if the indication of the ball is not immediately adjacent the indication of the particular defender and if each row of indications contain a defender.

3. A portable electronic soccer game as in claim 2 in which the means for generating input signals includes elements for causing the control circuit means to move the indication of the operator controlled offensive player to different positions in eight directions at forty-five degree intervals surrounding the one indication on the display, and elements for initiating a pass or a shot by an offensive player controlling the ball.

4. A portable electronic soccer game as in claim 3 in which the indication of the offensive player not carrying the ball is moved automatically by the control circuit means if that offensive player has not been selected to be controlled by the operator.

5. A portable electronic soccer game as in claim 4 in which the indication of the offensive player moved automatically by the control circuit means is moved to a position to receive a pass from the indication of the other offensive player, the position being toward the offensive goal and on a diagonal from the position of the indication of the other offensive player.

6. A portable electronic soccer game as in claim 2 in which the indications representing the defenders move automatically to intercept the ball under control of the control circuit means.

7. A portable electronic soccer game as in claim 2 in which the control circuit means includes means for automatically causing indications of defenders closer to the ball to move more frequently than indications of defenders farther from the ball.

8. A portable electronic soccer game as in claim 6 in which the control circuit means causes a ball the indication for which is attempting to enter or remain in the same position as an indication of a defender to either be taken over by the defender or rebounded to an indication of an offensive player.

9. A portable electronic soccer game as in claim 6 in which the control circuit means causes a ball the indication for which is attempting to enter or remain in the same position as an indication of a defender to either be taken over by the defender or kicked away from the indication of an offensive player.

10. A portable electronic soccer game as in claim 9 in which the control circuit means may cause a ball kicked away from the indication of an offensive player to score a goal for the defensive team.

11. A portable electronic soccer game as in claim 2 in which the control circuit means includes means for displaying indications on the display of the time remaining in the game, the team on offense, the zone in which play is taking place, and the score of the game.

12. An electronic game comprising:

means for representing a playing field;

means for representing a target symbol on the field;

means for representing defensive symbols on the field;

means for generating input signals to cause movement of the target symbol;

means for establishing intervals of play time;

means for establishing a selection probability function which provides a selection probability based on the number of defensive symbols;

first assignment means for assigning a particular selection probability to each defensive symbol as a function of the selection probability function and the number of defensive symbols;

means for selecting at a particular interval of time a particular defensive symbol as a candidate for movement as a function of the particular selection probability assigned to that particular symbol;

means for establishing a movement probability function which provides a movement probability based on the distance between the target symbol and any defensive symbol;

means for determining at the particular interval of time the distance between the target symbol and the particular defensive symbol;

second assignment means for assigning at the particular interval of time a particular movement probability to the particular defensive symbol as a function of the movement probability function and the distance between the target symbol and the particular defensive symbol;

movement determining means for determining at the particular interval of time whether the particular defensive symbol is to be moved as a function of the particular movement probability; and means responsive to the movement determining means for automatically moving the particular defensive symbol toward the target symbol.

13. The electronic game of claim 12 in which the movement probability function provides an increase in the movement probability as the distance between any defensive symbol and the target symbol decreases.

* * * * *